US008714937B2

(12) United States Patent
Fitton et al.

(10) Patent No.: US 8,714,937 B2
(45) Date of Patent: May 6, 2014

(54) FAN ASSEMBLY

(75) Inventors: Nicholas Gerald Fitton, Malmesbury (GB); John Scott Sutton, Malmesbury (GB); Peter David Gammack, Malmesbury (GB); James Dyson, Malmesbury (GB); John David Wallace, Malmesbury (GB); Arran George Smith, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 13/481,268

(22) Filed: May 25, 2012

(65) Prior Publication Data

US 2012/0230658 A1 Sep. 13, 2012

Related U.S. Application Data

(63) Continuation of application No. 12/716,780, filed on Mar. 3, 2010, now Pat. No. 8,197,226.

(30) Foreign Application Priority Data

Mar. 4, 2009 (GB) ..... 0903682.3
Jun. 29, 2009 (GB) ..... 0911178.2

(51) Int. Cl.

| | |
|---|---|
| ***F04F 5/06*** | (2006.01) |
| ***F04F 5/14*** | (2006.01) |
| ***F04F 5/46*** | (2006.01) |
| ***F04F 5/50*** | (2006.01) |
| ***F04D 29/44*** | (2006.01) |
| ***F04D 29/58*** | (2006.01) |

(52) U.S. Cl.

CPC ..... *F04D 29/441* (2013.01); *F04D 29/582* (2013.01); *F04D 5/46* (2013.01)

USPC ..... 417/84; 417/177; 417/198; 239/568

(58) Field of Classification Search

CPC ..... F04D 29/441; F04D 29/4226; F04F 5/46

USPC ..... 239/265.17, 434.5, 561, 568, DIG. 7; 417/76, 84, 155, 177, 198

See application file for complete search history.

(56) References Cited

U.S. PATENT DOCUMENTS

| | | | |
|---|---|---|---|
| 1,357,261 | A | 11/1920 | Svoboda |
| 1,767,060 | A | 6/1930 | Ferguson |

(Continued)

FOREIGN PATENT DOCUMENTS

| | | |
|---|---|---|
| BE | 560119 | 8/1957 |
| CA | 1055344 | 5/1979 |

(Continued)

OTHER PUBLICATIONS

Gammack et al., Office Action mailed Sep. 17, 2012, directed to U.S. Appl. No. 13/114,707; 12 pages.

(Continued)

*Primary Examiner* — Bryan Lettman
(74) *Attorney, Agent, or Firm* — Morrison & Foerster LLP

(57) ABSTRACT

A bladeless fan assembly for creating an air current includes a nozzle mounted on a base housing a device for creating an air flow. The nozzle includes an interior passage for receiving the air flow and a mouth for emitting the air flow. The nozzle defines, and extends about, an opening through which air from outside the fan assembly is drawn by the air flow emitted from the mouth. The nozzle also includes a heater for heating the air flow upstream of the mouth.

26 Claims, 19 Drawing Sheets

(56) References Cited

U.S. PATENT DOCUMENTS 1,896,869 A 2/1933 Larsh
1,961,179 A 6/1934 Tinkham
2,014,185 A 9/1935 Martin
2,035,733 A 3/1936 Wall
D103,476 S 3/1937 Weber
2,115,883 A 5/1938 Sher
D115,344 S 6/1939 Chapman
2,210,458 A 8/1940 Keilholtz
2,258,961 A 10/1941 Saathoff
2,295,502 A 9/1942 Lamb
2,336,295 A 12/1943 Reimuller
2,363,839 A 11/1944 Demuth
2,433,795 A 12/1947 Stokes
2,473,325 A 6/1949 Aufiero
2,476,002 A 7/1949 Stalker
2,488,467 A 11/1949 De Lisio
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,047,208 A 7/1962 Coanda
3,270,655 A 9/1966 Guirl et al.
D206,973 S 2/1967 De Lisio
3,503,138 A 3/1970 Fuchs et al.
3,518,776 A 7/1970 Wolff et al.
3,724,092 A 4/1973 McCleerey
3,743,186 A 7/1973 Mocarski
3,795,367 A 3/1974 Mocarski
3,872,916 A 3/1975 Beck
3,875,745 A 4/1975 Franklin
3,885,891 A 5/1975 Throndson
3,943,329 A 3/1976 Hlavac
4,037,991 A 7/1977 Taylor
4,046,492 A 9/1977 Inglis
4,061,188 A 12/1977 Beck
4,073,613 A 2/1978 Desty
4,113,416 A 9/1978 Kataoka et al.
4,136,735 A 1/1979 Beck et al.
4,173,995 A 11/1979 Beck
4,180,130 A 12/1979 Beck et al.
4,184,541 A 1/1980 Beck et al.
4,192,461 A 3/1980 Arborg
4,332,529 A 6/1982 Alperin
4,336,017 A 6/1982 Desty
4,342,204 A 8/1982 Melikian et al.
4,448,354 A 5/1984 Reznick et al.
4,568,243 A 2/1986 Schubert et al.
4,630,475 A 12/1986 Mizoguchi
4,643,351 A 2/1987 Fukamachi et al.
4,703,152 A 10/1987 Shih-Chin
4,718,870 A 1/1988 Watts
4,732,539 A 3/1988 Shin-Chin
4,790,133 A 12/1988 Stuart
4,850,804 A 7/1989 Huang
4,878,620 A 11/1989 Tarleton
4,893,990 A 1/1990 Tomohiro et al.
4,978,281 A 12/1990 Conger, IV
5,061,405 A 10/1991 Stanek et al.
D325,435 S 4/1992 Coup et al.
5,168,722 A 12/1992 Brock
5,176,856 A 1/1993 Takahashi et al.
5,188,508 A 2/1993 Scott et al.
5,296,769 A 3/1994 Havens et al.
5,310,313 A 5/1994 Chen
5,317,815 A 6/1994 Hwang
5,402,938 A 4/1995 Sweeney
5,407,324 A 4/1995 Starnes, Jr. et al.
5,425,902 A 6/1995 Miller et al.
5,449,275 A 9/1995 Gluszek et al.
5,518,370 A 5/1996 Wang et al.
5,609,473 A 3/1997 Litvin
5,645,769 A 7/1997 Tamaru et al.
5,649,370 A 7/1997 Russo
5,671,321 A 9/1997 Bagnuolo
5,735,683 A 4/1998 Muschelknautz
5,762,034 A * 6/1998 Foss ..... 123/41.49
5,762,661 A 6/1998 Kleinberger et al.
5,783,117 A 7/1998 Byassee et al.
D398,983 S 9/1998 Keller et al.
5,841,080 A 11/1998 Iida et al.
5,843,344 A 12/1998 Junket et al.
5,862,037 A 1/1999 Behl
5,868,197 A 2/1999 Potier
5,881,685 A 3/1999 Foss et al.
D415,271 S 10/1999 Feer
6,015,274 A 1/2000 Bias et al.
6,073,881 A 6/2000 Chen
D429,808 S 8/2000 Krauss et al.
6,123,618 A 9/2000 Day
6,155,782 A 12/2000 Hsu
D435,899 S 1/2001 Melwani
6,241,600 B1 * 6/2001 Uehara ..... 454/252
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,386,845 B1 5/2002 Bedard
6,480,672 B1 11/2002 Rosenzweig et al.
6,599,088 B2 7/2003 Stagg
6,604,694 B1 8/2003 Kordas et al.
D485,895 S 1/2004 Melwani
6,789,787 B2 9/2004 Stutts
6,791,056 B2 9/2004 VanOtteren et al.
6,830,433 B2 12/2004 Birdsell et al.
7,059,826 B2 6/2006 Lasko
7,088,913 B1 8/2006 Verhoorn et al.
7,147,336 B1 12/2006 Chou
D539,414 S 3/2007 Russak et al.
7,412,781 B2 8/2008 Mattinger et al.
7,478,993 B2 1/2009 Hong et al.
7,540,474 B1 6/2009 Huang et al.
D598,532 S 8/2009 Dyson et al.
D602,143 S 10/2009 Gammack et al.
D602,144 S 10/2009 Dyson et al.
D605,748 S 12/2009 Gammack et al.
7,664,377 B2 2/2010 Liao
D614,280 S 4/2010 Dyson et al.
7,731,050 B2 6/2010 Parks et al.
7,775,848 B1 8/2010 Auerbach
7,806,388 B2 10/2010 Junkel et al.
7,841,045 B2 11/2010 Shaanan et al.
8,029,244 B2 * 10/2011 Dumas et al. ..... 417/176
8,092,166 B2 1/2012 Nicolas et al.
8,152,495 B2 4/2012 Boggess, Jr. et al.
8,246,317 B2 8/2012 Gammack
2002/0106547 A1 8/2002 Sugawara et al.
2003/0059307 A1 3/2003 Moreno et al.
2003/0164367 A1 9/2003 Bucher et al.
2003/0171093 A1 9/2003 Gumucio Del Pozo
2003/0234630 A1 12/2003 Blake
2004/0022631 A1 2/2004 Birdsell et al.
2004/0049842 A1 3/2004 Prehodka
2004/0149881 A1 8/2004 Allen
2005/0031448 A1 2/2005 Lasko et al.
2005/0053465 A1 3/2005 Roach et al.
2005/0069407 A1 3/2005 Winkler et al.
2005/0128698 A1 6/2005 Huang
2005/0163670 A1 7/2005 Alleyne et al.
2005/0173997 A1 8/2005 Schmid et al.
2005/0281672 A1 12/2005 Parker et al.
2006/0172682 A1 8/2006 Orr et al.
2006/0199515 A1 9/2006 Lasko et al.
2006/0263073 A1 11/2006 Clarke et al.

(56) References Cited

U.S. PATENT DOCUMENTS

| | | | | |
|---|---|---|---|---|
| 2007/0035189 | A1 | 2/2007 | Matsumoto | |
| 2007/0041857 | A1 | 2/2007 | Fleig | |
| 2007/0065280 | A1 | 3/2007 | Fok | |
| 2007/0166160 | A1 | 7/2007 | Russak et al. | |
| 2007/0176502 | A1 | 8/2007 | Kasai et al. | |
| 2007/0224044 | A1 | 9/2007 | Hong et al. | |
| 2007/0269323 | A1 | 11/2007 | Zhou et al. | |
| 2008/0020698 | A1 | 1/2008 | Spaggiari | |
| 2008/0124060 | A1 | 5/2008 | Gao | |
| 2008/0152482 | A1 | 6/2008 | Patel | |
| 2008/0166224 | A1 | 7/2008 | Giffin | |
| 2008/0286130 | A1 | 11/2008 | Purvines | |
| 2008/0314250 | A1 | 12/2008 | Cowie et al. | |
| 2009/0026850 | A1 | 1/2009 | Fu | |
| 2009/0032130 | A1* | 2/2009 | Dumas et al. | 137/829 |
| 2009/0039805 | A1 | 2/2009 | Tang | |
| 2009/0060710 | A1 | 3/2009 | Gammack et al. | |
| 2009/0060711 | A1 | 3/2009 | Gammack et al. | |
| 2009/0120925 | A1 | 5/2009 | Lasko | |
| 2009/0191054 | A1 | 7/2009 | Winkler | |
| 2009/0214341 | A1 | 8/2009 | Craig | |
| 2010/0150699 | A1 | 6/2010 | Nicolas et al. | |
| 2010/0162011 | A1 | 6/2010 | Min | |
| 2010/0171465 | A1 | 7/2010 | Seal et al. | |
| 2010/0225012 | A1 | 9/2010 | Fitton et al. | |
| 2010/0226749 | A1 | 9/2010 | Gammack et al. | |
| 2010/0226750 | A1 | 9/2010 | Gammack | |
| 2010/0226751 | A1 | 9/2010 | Gammack et al. | |
| 2010/0226752 | A1 | 9/2010 | Gammack et al. | |
| 2010/0226753 | A1 | 9/2010 | Dyson et al. | |
| 2010/0226754 | A1 | 9/2010 | Hutton et al. | |
| 2010/0226758 | A1 | 9/2010 | Cookson et al. | |
| 2010/0226763 | A1 | 9/2010 | Gammack et al. | |
| 2010/0226764 | A1 | 9/2010 | Gammack et al. | |
| 2010/0226769 | A1 | 9/2010 | Helps | |
| 2010/0226771 | A1 | 9/2010 | Crawford et al. | |
| 2010/0226787 | A1 | 9/2010 | Gammack et al. | |
| 2010/0226797 | A1 | 9/2010 | Fitton et al. | |
| 2010/0226801 | A1 | 9/2010 | Gammack | |
| 2010/0254800 | A1 | 10/2010 | Fitton et al. | |
| 2010/0256821 | A1 | 10/2010 | Jeung et al. | |
| 2011/0058935 | A1 | 3/2011 | Gammack et al. | |
| 2011/0070084 | A1 | 3/2011 | Kuang | |
| 2011/0110805 | A1 | 5/2011 | Gammack et al. | |
| 2011/0123181 | A1 | 5/2011 | Ariga | |
| 2011/0164959 | A1 | 7/2011 | Fitton et al. | |
| 2011/0198340 | A1 | 8/2011 | Zimmer et al. | |
| 2011/0223014 | A1 | 9/2011 | Crawford et al. | |
| 2011/0223015 | A1 | 9/2011 | Gammack et al. | |
| 2012/0031509 | A1 | 2/2012 | Wallace et al. | |
| 2012/0033952 | A1 | 2/2012 | Wallace et al. | |
| 2012/0034108 | A1 | 2/2012 | Wallace et al. | |
| 2012/0039705 | A1 | 2/2012 | Gammack | |
| 2012/0045315 | A1 | 2/2012 | Gammack | |
| 2012/0045316 | A1 | 2/2012 | Gammack | |
| 2012/0057959 | A1 | 3/2012 | Hodgson et al. | |
| 2012/0082561 | A1 | 4/2012 | Gammack et al. | |
| 2012/0093629 | A1 | 4/2012 | Fitton et al. | |
| 2012/0093630 | A1 | 4/2012 | Fitton et al. | |
| 2012/0114513 | A1 | 5/2012 | Simmonds et al. | |
| 2012/0230658 | A1 | 9/2012 | Fitton et al. | |
| 2013/0272685 | A1 | 10/2013 | Leow et al. | |
| 2013/0280099 | A1 | 10/2013 | Park et al. | |

FOREIGN PATENT DOCUMENTS

| | | |
|---|---|---|
| CA | 2155482 | 9/1996 |
| CH | 346643 | 5/1960 |
| CN | 2085866 | 10/1991 |
| CN | 2111392 | 7/1992 |
| CN | 1437300 | 8/2003 |
| CN | 2650005 | 10/2004 |
| CN | 2713643 | 7/2005 |
| CN | 1680727 | 10/2005 |
| CN | 2833197 | 11/2006 |
| CN | 201180678 | 1/2009 |
| CN | 201221477 | 4/2009 |
| CN | 201281416 | 7/2009 |
| CN | 201349269 | 11/2009 |
| CN | 101749288 | 6/2010 |
| CN | 201502549 | 6/2010 |
| CN | 201568337 | 9/2010 |
| CN | 101936310 | 1/2011 |
| CN | 101984299 | 3/2011 |
| CN | 101985948 | 3/2011 |
| CN | 201763705 | 3/2011 |
| CN | 201763706 | 3/2011 |
| CN | 201770513 | 3/2011 |
| CN | 201779080 | 3/2011 |
| CN | 201802648 | 4/2011 |
| CN | 102095236 | 6/2011 |
| CN | 102367813 | 3/2012 |
| DE | 1 291 090 | 3/1969 |
| DE | 24 51 557 | 5/1976 |
| DE | 27 48 724 | 5/1978 |
| DE | 3644567 | 7/1988 |
| DE | 195 10 397 | 9/1996 |
| DE | 197 12 228 | 10/1998 |
| DE | 100 00 400 | 3/2001 |
| DE | 10041805 | 6/2002 |
| DE | 10 2009 007 037 | 8/2010 |
| EP | 0 044 494 | 1/1982 |
| EP | 0186581 | 7/1986 |
| EP | 1 094 224 | 4/2001 |
| EP | 1 138 954 | 10/2001 |
| EP | 1 779 745 | 5/2007 |
| EP | 1 939 456 | 7/2008 |
| EP | 1 980 432 | 10/2008 |
| EP | 2 000 675 | 12/2008 |
| EP | 2191142 | 6/2010 |
| FR | 1033034 | 7/1953 |
| FR | 1095114 | 5/1955 |
| FR | 1119439 | 6/1956 |
| FR | 1.387.334 | 1/1965 |
| FR | 2 534 983 | 4/1984 |
| FR | 2 640 857 | 6/1990 |
| FR | 2 658 593 | 8/1991 |
| FR | 2794195 | 12/2000 |
| FR | 2 874 409 | 2/2006 |
| FR | 2 906 980 | 4/2008 |
| FR | 2928706 | 9/2009 |
| GB | 22235 | 0/1914 |
| GB | 383498 | 11/1932 |
| GB | 593828 | 10/1947 |
| GB | 601222 | 4/1948 |
| GB | 633273 | 12/1949 |
| GB | 641622 | 8/1950 |
| GB | 661747 | 11/1951 |
| GB | 863 124 | 3/1961 |
| GB | 1067956 | 5/1967 |
| GB | 1 262 131 | 2/1972 |
| GB | 1 265 341 | 3/1972 |
| GB | 1 278 606 | 6/1972 |
| GB | 1 304 560 | 1/1973 |
| GB | 1 403 188 | 8/1975 |
| GB | 1 434 226 | 5/1976 |
| GB | 1 501 473 | 2/1978 |
| GB | 2 094 400 | 9/1982 |
| GB | 2 107 787 | 5/1983 |
| GB | 2 111 125 | 6/1983 |
| GB | 2 178 256 | 2/1987 |
| GB | 2 185 531 | 7/1987 |
| GB | 2 185 533 | 7/1987 |
| GB | 2 218 196 | 11/1989 |
| GB | 2 236 804 | 4/1991 |
| GB | 2 240 268 | 7/1991 |
| GB | 2 242 935 | 10/1991 |
| GB | 2 285 504 | 7/1995 |
| GB | 2 289 087 | 11/1995 |
| GB | 2383277 | 6/2003 |
| GB | 2 428 569 | 2/2007 |
| GB | 2 452 593 | 3/2009 |
| GB | 2452490 | 3/2009 |

(56) References Cited

FOREIGN PATENT DOCUMENTS

| | | | | |
|---|---|---|---|---|
| GB | 2463698 | | 3/2010 | |
| GB | 2464736 | | 4/2010 | |
| GB | 2466058 | | 6/2010 | |
| GB | 2468312 | | 9/2010 | |
| GB | 2468313 | | 9/2010 | |
| GB | 2468315 | | 9/2010 | |
| GB | 2468319 | | 9/2010 | |
| GB | 2468320 | | 9/2010 | |
| GB | 2468323 | | 9/2010 | |
| GB | 2468328 | | 9/2010 | |
| GB | 2468331 | | 9/2010 | |
| GB | 2468369 | | 9/2010 | |
| GB | 2473037 | | 3/2011 | |
| GB | 2479760 | | 10/2011 | |
| GB | 2482547 | | 2/2012 | |
| JP | 31-13055 | | 8/1956 | |
| JP | 35-4369 | | 3/1960 | |
| JP | 39-7297 | | 3/1964 | |
| JP | 49-150403 | | 12/1974 | |
| JP | 51-7258 | | 1/1976 | |
| JP | 53-60100 | | 5/1978 | |
| JP | 56-167897 | | 12/1981 | |
| JP | S57-8396 | | 1/1982 | |
| JP | 57-71000 | | 5/1982 | |
| JP | 57-157097 | | 9/1982 | |
| JP | 61-31830 | | 2/1986 | |
| JP | 61-116093 | | 6/1986 | |
| JP | 61-280787 | | 12/1986 | |
| JP | 62-223494 | | 10/1987 | |
| JP | 63-179198 | | 7/1988 | |
| JP | 63-306340 | | 12/1988 | |
| JP | 64-21300 | U | 2/1989 | |
| JP | 64-83884 | | 3/1989 | |
| JP | 1-138399 | | 5/1989 | |
| JP | 1-224598 | | 9/1989 | |
| JP | 2-146294 | | 6/1990 | |
| JP | 2-218890 | | 8/1990 | |
| JP | 2-248690 | | 10/1990 | |
| JP | 3-52515 | | 5/1991 | |
| JP | 3-123520 | | 5/1991 | |
| JP | 3-267598 | | 11/1991 | |
| JP | 4-43895 | | 2/1992 | |
| JP | 64-21300 | * | 2/1992 | ..... F04F 5/16 |
| JP | 4-366330 | | 12/1992 | |
| JP | 5-157093 | | 6/1993 | |
| JP | 5-164089 | | 6/1993 | |
| JP | 5-263786 | | 10/1993 | |
| JP | 6-74190 | | 3/1994 | |
| JP | 6-86898 | | 3/1994 | |
| JP | 6-147188 | | 5/1994 | |
| JP | 6-257591 | | 9/1994 | |
| JP | 6-280800 | | 10/1994 | |
| JP | 6-336113 | | 12/1994 | |
| JP | 7-190443 | | 7/1995 | |
| JP | 8-21400 | | 1/1996 | |
| JP | 9-100800 | | 4/1997 | |
| JP | 9-287600 | | 11/1997 | |
| JP | 11-227866 | | 8/1999 | |
| JP | 2000-116179 | | 4/2000 | |
| JP | 2000-201723 | | 7/2000 | |
| JP | 2001-17358 | | 1/2001 | |
| JP | 2002-21797 | | 1/2002 | |
| JP | 2002-138829 | | 5/2002 | |
| JP | 2002-213388 | | 7/2002 | |
| JP | 2003-329273 | | 11/2003 | |
| JP | 2004-8275 | | 1/2004 | |
| JP | 2004-208935 | | 7/2004 | |
| JP | 2004-216221 | | 8/2004 | |
| JP | 2005-201507 | | 7/2005 | |
| JP | 2005-307985 | | 11/2005 | |
| JP | 2006-89096 | | 4/2006 | |
| JP | 3127331 | | 11/2006 | |
| JP | 2007-138763 | | 6/2007 | |
| JP | 2007-138789 | | 6/2007 | |
| JP | 2008-39316 | | 2/2008 | |
| JP | 2008-100204 | | 5/2008 | |
| JP | 3146538 | | 10/2008 | |
| JP | 2008-294243 | | 12/2008 | |
| JP | 2009-44568 | | 2/2009 | |
| JP | 2010-131259 | | 6/2010 | |
| KR | 10-2005-0102317 | | 10/2005 | |
| KR | 2007-0007997 | | 1/2007 | |
| KR | 10-2010-0055611 | | 5/2010 | |
| KR | 10-0985378 | | 9/2010 | |
| TW | M394383 | | 12/2010 | |
| TW | M407299 | | 7/2011 | |
| WO | WO 90/13478 | | 11/1990 | |
| WO | WO-95/06822 | | 3/1995 | |
| WO | WO-02/073096 | | 9/2002 | |
| WO | WO 03/058795 | | 7/2003 | |
| WO | WO-03/069931 | | 8/2003 | |
| WO | WO-2005/050026 | | 6/2005 | |
| WO | WO 2005/057091 | | 6/2005 | |
| WO | WO2005/057091 | * | 6/2005 | ..... F24H 3/04 |
| WO | WO-2006/008021 | | 1/2006 | |
| WO | WO-2006/012526 | | 2/2006 | |
| WO | WO 2007/024955 | | 3/2007 | |
| WO | WO 2007/048205 | | 5/2007 | |
| WO | WO 2008/014641 | | 2/2008 | |
| WO | WO-2008/024569 | | 2/2008 | |
| WO | WO-2008/139491 | | 11/2008 | |
| WO | WO-2009/030879 | | 3/2009 | |
| WO | WO-2009/030881 | | 3/2009 | |
| WO | WO-2010/100451 | | 9/2010 | |
| WO | WO-2010/100452 | | 9/2010 | |
| WO | WO-2010/100453 | | 9/2010 | |
| WO | WO-2010/100462 | | 9/2010 | |
| WO | WO-2012/017219 | | 2/2012 | |

OTHER PUBLICATIONS

Gammack et al., U.S. Office Action mailed Aug. 20, 2012, directed to U.S. Appl. No. 12/945,558; 15 pages.

Gammack, P. et al. U.S. Office Action mailed Oct. 18, 2012, directed to U.S. Appl. No. 12/917,247; 11 pages.

GB Search Report dated Jun. 5, 2009, directed to counterpart GB Application No. 0903682.3; 2 pages.

GB Search Report dated Oct. 14, 2009, directed to counterpart GB Application No. 0911178.2; 2 pages.

International Search Report and Written Opinion mailed Jul. 7, 2010, directed to International Application No. PCT/GB2010/050272; 12 pages.

Gammack, P. et al., U.S. Office Action mailed Dec. 9, 2010, directed to U.S. Appl. No. 12/203,698; 10 pages.

Gammack, P. et al., U.S. Office Action mailed Jun. 21,2011, directed to U.S. Appl. No. 12/203,698; 11 pages.

Gammack, P. et al., U.S. Office Action mailed Dec. 10, 2010, directed to U.S. Appl. No. 12/230,613; 12 pages.

Gammack, P. et al., U.S. Office Action mailed May 13, 2011, directed to U.S. Appl. No. 12/230,613; 13 pages.

Gammack, P. et al., U.S. Office Action mailed Sep. 7, 2011, directed to U.S. Appl. No. 12/230,613; 15 pages.

Gammack, P. et al., U.S. Office Action mailed Jun. 8, 2012, directed to U.S. Appl. No. 12/230,613; 15 pages.

Fitton et al., U.S. Office Action mailed Nov. 30, 2010 directed to U.S. Appl. No. 12/560,232; 9 pages.

Nicolas, F. et al., U.S. Office Action mailed Mar. 7, 2011, directed to U.S. Appl. No. 12/622,844; 10 pages.

Nicolas, F. et al., U.S. Office Action mailed Sep. 8, 2011, directed to U.S. Appl. No. 12/622,844; 11 pages.

Fitton, et al., U.S. Office Action mailed Mar. 8, 2011, directed to U.S. Appl. No. 12/716,780; 12 pages.

Fitton, et al., U.S. Office Action mailed Sep. 6, 2011, directed to U.S. Appl. No. 12/716,780; 16 pages.

Gammack, P. et al., U.S. Office Action mailed Dec. 9, 2010, directed to U.S. Appl. No. 12/716,781; 17 pages.

Gammack, P. et al., U.S. Final Office Action mailed Jun. 24, 2011, directed to U.S. Appl. No. 12/716,781; 19 pages.

Gammack, P. et al., U.S. Office Action mailed Apr. 12, 2011, directed to U.S. Appl. No. 12/716,749; 8 pages.

(56) References Cited

OTHER PUBLICATIONS

Gammack, P. et al., U.S. Office Action mailed Sep. 1, 2011, directed to U.S. Appl. No. 12/716,749; 9 pages.
Gammack, P. et al., U.S. Office Action mailed Jun. 25, 2012, directed to U.S. Appl. No. 12/716,749; 11 pages.
Fitton et al., U.S. Office Action mailed Mar. 30, 2012, directed to U.S. Appl. No. 12/716,707; 7 pages.
Gammack, P. et al., U.S. Office Action mailed May 24, 2011, directed to U.S. Appl. No. 12/716,613; 9 pages.
Reba, I. (1966). "Applications of the Coanda Effect," *Scientific American* 214:84-92.
Third Party Submission Under 37 CFR 1.99 filed Jun. 2, 2011, directed towards U.S. Appl. No. 12/203,698; 3 pages.
Wallace et al., Office Action mailed Oct. 23, 2013, directed to U.S. Appl. No. 13/192,223; 18 pages.
Wallace et al., Office Action mailed Jun. 7, 2013, directed towards U.S. Appl. No. 13/192,223; 30 pages.
Search Report dated May 24, 2013, directed towards EP Application No. 13160248; 2 pages.

* cited by examiner

FAN ASSEMBLY

REFERENCE TO RELATED APPLICATIONS

This application is a continuation of U.S. patent application Ser. No. 12/716,780, filed Mar. 3, 2010, which claims the priority of United Kingdom Application Nos. 0903682.3, filed 4 Mar. 2009, and Ser. No. 0911178.2, filed 29 Jun. 2009, the entire contents of which are incorporated herein by reference.

FIELD OF THE INVENTION

The present invention relates to a fan assembly. In a preferred embodiment, the present invention relates to a domestic fan, such as a tower fan, for creating a warm air current in a room, office or other domestic environment.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation.

Such fans are available in a variety of sizes and shapes. For example, a ceiling fan can be at least 1 m in diameter, and is usually mounted in a suspended manner from the ceiling to provide a downward flow of air to cool a room. On the other hand, desk fans are often around 30 cm in diameter, and are usually free standing and portable. Floor-standing tower fans generally comprise an elongate, vertically extending casing around 1 m high and housing one or more sets of rotary blades for generating an air flow. An oscillating mechanism may be employed to rotate the outlet from the tower fan so that the air flow is swept over a wide area of a room.

Fan heaters generally comprise a number of heating elements located either behind or in front of the rotary blades to enable a user to optionally heat the air flow generated by the rotating blades. The heating elements are commonly in the form of heat radiating coils or fins. A variable thermostat, or a number of predetermined output power settings, is usually provided to enable a user to control the temperature of the air flow emitted from the fan heater.

A disadvantage of this type of arrangement is that the air flow produced by the rotating blades of the fan heater is generally not uniform. This is due to variations across the blade surface or across the outward facing surface of the fan heater. The extent of these variations can vary from product to product and even from one individual fan heater to another. These variations result in the generation of a turbulent, or 'choppy', air flow which can be felt as a series of pulses of air and which can be uncomfortable for a user. A further disadvantage resulting from the turbulence of the air flow is that the heating effect of the fan heater can diminish rapidly with distance.

In a domestic environment it is desirable for appliances to be as small and compact as possible due to space restrictions. It is undesirable for parts of the appliance to project outwardly, or for a user to be able to touch any moving parts, such as the blades. Fan heaters tend to house the blades and the heat radiating coils within a moulded apertured casing to prevent user injury from contact with either the moving blades or the hot heat radiating coils, but such enclosed parts can be difficult to clean. Consequently, an amount of dust or other detritus can accumulate within the casing and on the heat radiating coils between uses of the fan heater. When the heat radiating coils are activated, the temperature of the outer surfaces of the coils can rise rapidly, particularly when the power output from the coils is relatively high, to a value in excess of 700° C. Consequently, some of the dust which has settled on the coils between uses of the fan heater can be burnt, resulting in the emission of an unpleasant smell from the fan heater for a period of time.

SUMMARY OF THE INVENTION

In a first aspect the present invention provides a bladeless fan assembly for creating an air current, the fan assembly comprising a device for creating an air flow and a nozzle comprising an interior passage for receiving the air flow and a mouth for emitting the air flow, the nozzle defining and extending about an opening through which air from outside the fan assembly is drawn by the air flow emitted from the mouth, the fan assembly further comprising an air heater.

Through use of a bladeless fan assembly an air current can be generated and a cooling effect created without the use of a bladed fan. In comparison to a bladed fan assembly, the bladeless fan assembly leads to a reduction in both moving parts and complexity. Furthermore, without the use of a bladed fan to project the air current from the fan assembly, a relatively uniform air current can be generated and guided into a room or towards a user. The heated air flow can travel efficiently out from the nozzle, losing less energy and velocity to turbulence than the air flow generated by prior art fan heaters. An advantage for a user is that the heated air flow can be experienced more rapidly at a distance of several meters from the fan assembly than when a prior art fan heater using a bladed fan is used to project the heated air flow from the fan assembly.

The term 'bladeless' is used to describe a fan assembly in which air flow is emitted or projected forward from the fan assembly without the use of moving blades. Consequently, a bladeless fan assembly can be considered to have an output area, or emission zone, absent moving blades from which the air flow is directed towards a user or into a room. The output area of the bladeless fan assembly may be supplied with a primary air flow generated by one of a variety of different sources, such as pumps, generators, motors or other fluid transfer devices, and which may include a rotating device such as a motor rotor and/or a bladed impeller for generating the air flow. The generated primary air flow can pass from the room space or other environment outside the fan assembly through the interior passage to the nozzle, and then back out to the room space through the mouth of the nozzle.

Hence, the description of a fan assembly as bladeless is not intended to extend to the description of the power source and components such as motors that are required for secondary fan functions. Examples of secondary fan functions can include lighting, adjustment and oscillation of the fan assembly.

The direction in which air is emitted from the mouth is preferably substantially at a right angle to the direction in which the air flow passes through at least part of the interior passage. Preferably, the air flow passes through at least part of the interior passage in a substantially vertical plane, and the air is emitted from the mouth in a substantially horizontal direction. The interior passage is preferably located towards the front of the nozzle, whereas the mouth is preferably located towards the rear of the nozzle and arranged to direct air towards the front of the nozzle and through the opening. Consequently, the mouth is preferably shaped so as substantially to reverse the flow direction of the air as it passes from the interior passage to an outlet of the mouth. The mouth is preferably substantially U-shaped in cross-section, and preferably narrows towards the outlet thereof.

The shape of the nozzle is not constrained by the requirement to include space for a bladed fan. Preferably, the nozzle surrounds the opening. For example, the nozzle may extend about the opening by a distance in the range from 50 to 250 cm. The nozzle may be an elongate, annular nozzle which preferably has a height in the range from 500 to 1000 mm, and a width in the range from 100 to 300 mm. Alternatively, the nozzle may be a generally circular annular nozzle which preferably has a height in the range from 50 to 400 mm. The interior passage is preferably annular, and is preferably shaped to divide the air flow into two air streams which flow in opposite directions around the opening.

The nozzle preferably comprises an inner casing section and an outer casing section which define the interior passage. Each section is preferably formed from a respective annular member, but each section may be provided by a plurality of members connected together or otherwise assembled to form that section. The outer casing section is preferably shaped so as to partially overlap the inner casing section to define at least one outlet of the mouth between overlapping portions of the external surface of the inner casing section and the internal surface of the outer casing section of the nozzle. Each outlet is preferably in the form of a slot, preferably having a width in the range from 0.5 to 5 mm. The mouth may comprise a plurality of such outlets spaced about the opening. For example, one or more sealing members may be located within the mouth to define a plurality of spaced apart outlets. Such outlets are preferably of substantially the same size. Where the nozzle is in the form of an elongate, annular nozzle, each outlet is preferably located along a respective elongate side of the inner periphery of the nozzle.

The nozzle may comprise a plurality of spacers for urging apart the overlapping portions of the inner casing section and the outer casing section of the nozzle. This can assist in maintaining a substantially uniform outlet width about the opening. The spacers are preferably evenly spaced along the outlet.

The nozzle may comprise a plurality of stationary guide vanes located within the interior passage and each for directing a portion of the air flow towards the mouth. The use of such guide vanes can assist in producing a substantially uniform distribution of the air flow through the mouth.

The nozzle may comprise a surface located adjacent the mouth and over which the mouth is arranged to direct the air flow emitted therefrom. Preferably, this surface is a curved surface, and more preferably is a Coanda surface. Preferably, the external surface of the inner casing section of the nozzle is shaped to define the Coanda surface. A Coanda surface is a known type of surface over which fluid flow exiting an output orifice close to the surface exhibits the Coanda effect. The fluid tends to flow over the surface closely, almost 'clinging to' or 'hugging' the surface. The Coanda effect is already a proven, well documented method of entrainment in which a primary air flow is directed over a Coanda surface. A description of the features of a Coanda surface, and the effect of fluid flow over a Coanda surface, can be found in articles such as Reba, Scientific American, Volume 214, June 1966 pages 84 to 92. Through use of a Coanda surface, an increased amount of air from outside the fan assembly is drawn through the opening by the air emitted from the mouth.

In a preferred embodiment an air flow is created through the nozzle of the fan assembly. In the following description this air flow will be referred to as the primary air flow. The primary air flow is emitted from the mouth of the nozzle and preferably passes over a Coanda surface. The primary air flow entrains air surrounding the mouth of the nozzle, which acts as an air amplifier to supply both the primary air flow and the entrained air to the user. The entrained air will be referred to here as a secondary air flow. The secondary air flow is drawn from the room space, region or external environment surrounding the mouth of the nozzle and, by displacement, from other regions around the fan assembly, and passes predominantly through the opening defined by the nozzle. The primary air flow directed over the Coanda surface combined with the entrained secondary air flow equates to a total air flow emitted or projected forward from the opening defined by the nozzle.

Preferably, the nozzle comprises a diffuser surface located downstream of the Coanda surface. The diffuser surface directs the air flow emitted towards a user's location while maintaining a smooth, even output, generating a suitable cooling effect without the user feeling a 'choppy' flow. Preferably, the external surface of the inner casing section of the nozzle is shaped to define the diffuser surface.

Preferably the device for creating an air flow through the nozzle comprises an impeller driven by a motor. This can provide a fan assembly with efficient air flow generation. The means for creating an air flow preferably comprises a DC brushless motor and a mixed flow impeller. This can avoid frictional losses and carbon debris from the brushes used in a traditional brushed motor. Reducing carbon debris and emissions is advantageous in a clean or pollutant sensitive environment such as a hospital or around those with allergies. While induction motors, which are generally used in bladed fans, also have no brushes, a DC brushless motor can provide a much wider range of operating speeds than an induction motor.

The heater may be arranged to heat the primary air flow upstream of the mouth, with the secondary air flow being used to convey the heated primary air flow away from the fan assembly. Therefore, in a second aspect the present invention provides a bladeless fan assembly for creating an air current, the fan assembly comprising a device for creating an air flow and a nozzle comprising an interior passage for receiving the air flow and a mouth for emitting the air flow, the nozzle defining and extending about an opening through which air from outside the fan assembly is drawn by the air flow emitted from the mouth, the fan assembly further comprising a heater for heating the air flow upstream of the mouth.

Additionally, or alternatively, the heater may be arranged to heat the secondary air flow. In one embodiment, at least part of the heater is located downstream from the mouth to enable the heater to heat both the primary air flow and the secondary air flow.

Preferably, the nozzle comprises the heater. At least part of the heater may be located within the nozzle. The fan assembly may comprise a plurality of heaters arranged within the nozzle so as to extend about the opening. Where the nozzle defines a circular opening, the heaters preferably extend at least 270° about the opening and more preferably at least 300° about the opening. Where the nozzle defines an elongate opening, the heaters are preferably located on at least the opposite elongate sides of the opening.

In one embodiment the heater is arranged within the interior passage to heat the primary air flow upstream of the mouth. The heater may be connected to one of the internal surface of the inner casing section and the internal surface of the outer casing section so that at least part of the primary air flow passes over the heater before being emitted from the mouth. For example, the heater may comprise a plurality of thin-film heaters connected to one, or both, of these internal surfaces.

Alternatively, the heater may be located between the internal surfaces so that substantially all of the primary air flow passes through the heater before being emitted from the mouth. For example, the heater may comprise a porous heater located within the interior passage so that the primary air flow passes through pores in the heater before being emitted from the mouth. The porous heater may be formed from ceramic material, preferably a PTC (positive temperature coefficient) ceramic heater which is capable of rapidly heating the air flow upon activation. The heater is preferably configured to prevent the temperature of the heater from rising above 200° C. so that no "burnt dust" odours are emitted from the fan assembly.

The ceramic material may be optionally coated in metallic or other electrically conductive material to facilitate connection of the heater to a controller within the fan assembly for activating the heater. Alternatively, at least one non-porous heater may be mounted within a metallic frame located within the interior passage and which is connected to the controller. The metallic frame serves to provide a greater surface area and hence better heat transfer, while also providing a means of electrical connection to the heater.

The inner casing section and the outer casing section of the nozzle may be formed from plastics material or other material having a relatively low thermal conductivity (less than 1 $Wm^{-1}K^{-1}$), to prevent the external surfaces of the nozzle from becoming excessively hot during use of the fan assembly. However, the inner casing section may be formed from material having a higher thermal conductivity than the outer casing section so that the inner casing section becomes heated by the heater. This can allow heat to be transferred from the internal surface of the inner casing section—located upstream of the mouth—to the primary air flow passing through the interior passage, and from the external surface of the inner casing section—located downstream of the mouth—to the primary and secondary air flows passing through the opening.

As an alternative to locating the heater within at least part of the nozzle, at least part of the heater may be located within a casing housing the device for creating an air flow, or within another part of the fan assembly through which the air flow passes. Therefore, in a third aspect the present invention provides a bladeless fan assembly for creating an air current, the fan assembly comprising a device for creating an air flow and a nozzle comprising an interior passage for receiving the air flow and a mouth for emitting the air flow, the nozzle defining and extending about an opening through which air from outside the fan assembly is drawn by the air flow emitted from the mouth, the fan assembly further comprising a porous heater through which the air flow passes.

As another example, the fan assembly may comprise a plurality of heaters located within the interior passage, and a plurality of heat radiating fins connected to the heaters and extending at least partially across the interior passage to transfer heat to the primary air flow. Two sets of such fins may be connected to each heater, with each set of fins extending from the heater towards a respective one of the internal surface of the inner casing section and the internal surface of the outer casing section of the nozzle.

Alternatively, the heater may be otherwise located within the nozzle so as to be in thermal contact with the interior passage to heat the air flow upstream from the mouth.

For example, the heater may be located within the inner casing section of the nozzle, with at least the internal surface of the inner casing section being formed from thermally conductive material to convey heat from the heater to the primary air flow passing through the interior passage. For example, the inner casing section may be formed from material having a thermal conductivity greater than 10 $Wm^{-1}K^{-1}$, and preferably from a metallic material such as aluminium or an aluminium alloy.

The fan assembly may comprise a plurality of heaters located within the inner casing section of the housing. For example, the fan assembly may comprise a plurality of cartridge heaters located between the internal surface and the external surface of the inner casing section. Where the nozzle is in the form of an elongate, annular nozzle, at least one heater may be located along each opposing elongate surface of the nozzle. For example, the fan assembly may comprise a plurality of sets of cartridge heaters, with each set of cartridge heaters being located along a respective side of the nozzle. Each set of cartridge heaters may comprise two or more cartridge heaters.

The heaters may be located between an inner portion and an outer portion of the inner casing section of the nozzle. At least the outer portion of the inner casing section of the nozzle, and preferably both the inner portion and the outer portion of the inner casing section of the nozzle, is preferably formed from material having a higher thermal conductivity than the outer casing section of the nozzle (preferably greater than 10 $Wm^{-1}K^{-1}$), and preferably from a metallic material such as aluminium or an aluminium alloy. The use of a material such as aluminium can assist in reducing the thermal load of the heating means, and thereby increase both the rate at which the temperature of the heating means increases upon activation and the rate at which the air is heated.

Such a portion of the inner casing section may be considered to form part of the heater. Consequently, the heater may partially define the interior passage of the nozzle. The heater may comprise one or both of the Coanda surface and the diffuser surface.

The heaters may be selectively activated by the user, either individually or in pre-defined combinations, to vary the temperature of the air current emitted from the nozzle.

The heater may protrude at least partially across the opening. In one embodiment, the heater comprises a plurality of heat radiating fins extending at least partially across the opening. This can assist in increasing the rate at which heat is transferred from the heater to the air passing through the opening. Where the nozzle is in the form of an elongate, annular nozzle, a stack of heat radiating fins may be located along each of the opposing elongate surfaces of the nozzle. Any dust or other detritus which may have settled on the upper surfaces of the heat radiating fins between successive uses of the fan assembly can be rapidly blown from those surfaces by the air flow drawn through the opening when the fan assembly is switched on. During use, an external surface temperature of the heater is preferably in the range from 40 to 70° C., preferably no more than around 50° C., so that user injury from accidental contact with the heat radiating fins or other external surface of the heater, and the "burning" of any dust remaining on the external surfaces of the heater, can be avoided.

The fan assembly may be desk or floor standing, or wall or ceiling mountable.

In a fourth aspect the present invention provides a fan heater comprising a mouth for emitting an air flow, the mouth extending about an opening through which air from outside the fan heater is drawn by the air flow emitted from the mouth, and a Coanda surface over which the mouth is arranged to direct the air flow, the fan heater further comprising an air heater.

In a fifth aspect the present invention provides a nozzle for a fan assembly for creating an air current, the nozzle comprising an interior passage for receiving an air flow and a mouth for emitting the air flow, the nozzle defining and extending about an opening through which air from outside the nozzle is drawn by the air flow emitted from the mouth, the nozzle further comprising an air heater.

In a sixth aspect the present invention provides a fan assembly comprising a nozzle as aforementioned.

Features of the first aspect of the invention are equally applicable to any of the second to sixth aspects of the invention, and vice versa.

BRIEF DESCRIPTION OF THE DRAWINGS

The present invention will now be described, by way of example only, with reference to the accompanying drawings, in which.

DETAILED DESCRIPTION OF THE INVENTION

Figure 1:
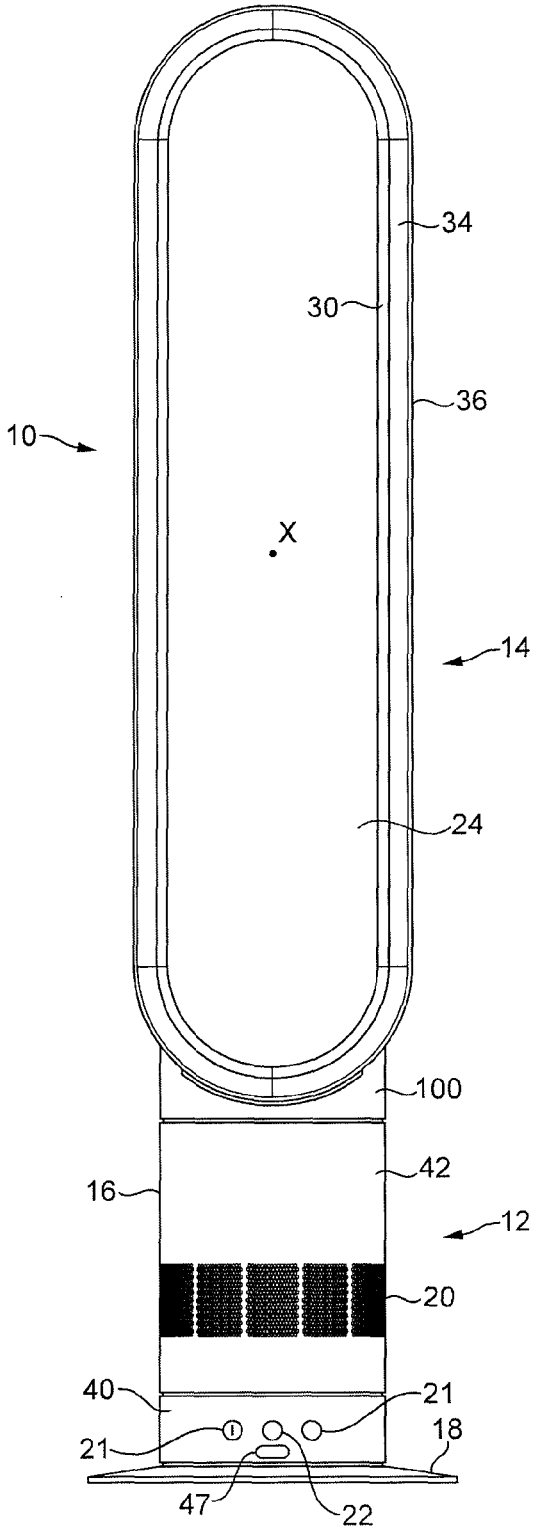
FIG. 1 is a front view of a domestic fan.
Figure 2:
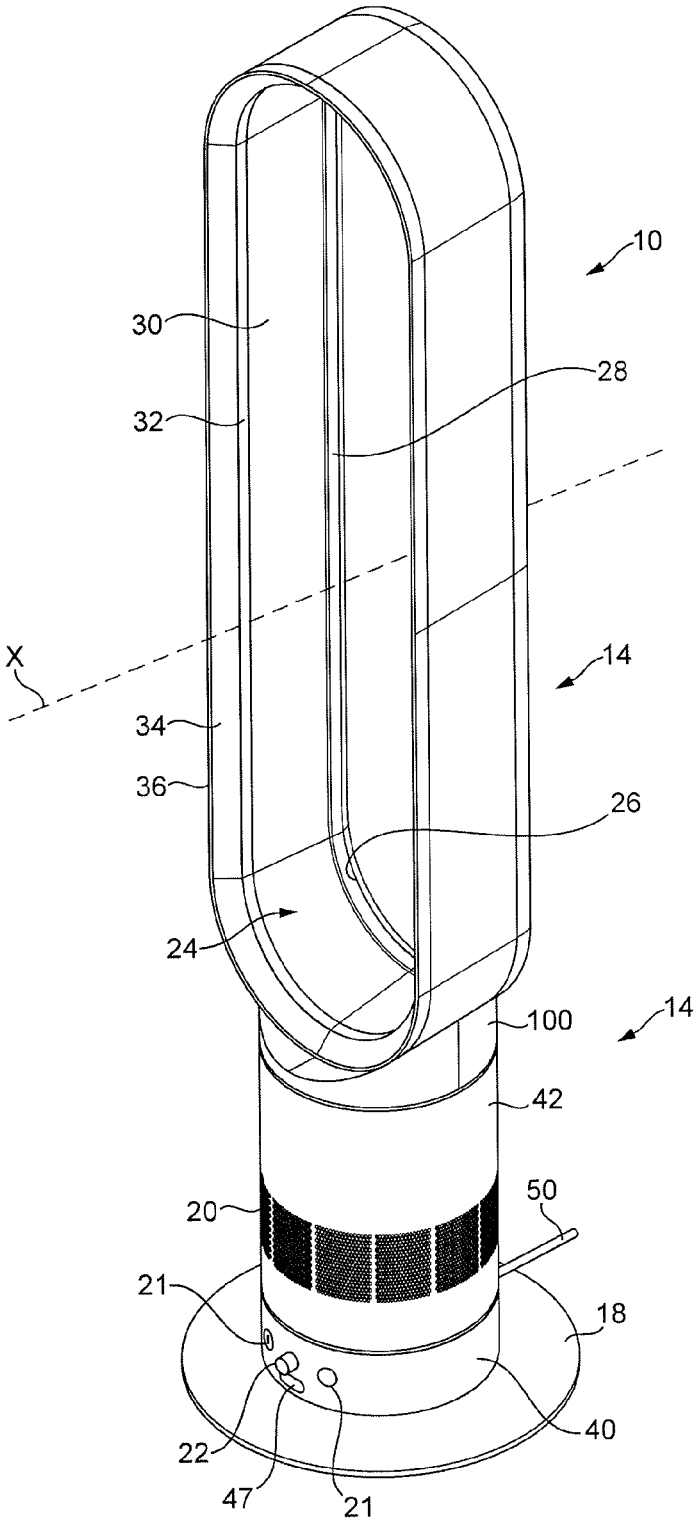
FIG. 2 is a perspective view of the fan of FIG. 1.

FIGS. 1 and 2 illustrate an example of a bladeless fan assembly. In this example, the bladeless fan assembly is in the form of a domestic tower fan 10 comprising a base 12 and a nozzle 14 mounted on and supported by the base 12. The base 12 comprises a substantially cylindrical outer casing 16 mounted optionally on a disc-shaped base plate 18. The outer casing 16 comprises a plurality of air inlets 20 in the form of apertures formed in the outer casing 16 and through which a primary air flow is drawn into the base 12 from the external environment. The base 12 further comprises a plurality of user-operable buttons 21 and a user-operable dial 22 for controlling the operation of the fan 10. In this example the base 12 has a height in the range from 200 to 300 mm, and the outer casing 16 has a diameter in the range from 100 to 200 mm.

The nozzle 14 has an elongate, annular shape and defines a central elongate opening 24. The nozzle 14 has a height in the range from 500 to 1000 mm, and a width in the range from 150 to 400 mm. In this example, the height of the nozzle is around 750 mm and the width of the nozzle is around 190 mm. The nozzle 14 comprises a mouth 26 located towards the rear of the fan 10 for emitting air from the fan 10 and through the opening 24. The mouth 26 extends at least partially about the opening 24. The inner periphery of the nozzle 14 comprises a Coanda surface 28 located adjacent the mouth 26 and over which the mouth 26 directs the air emitted from the fan 10, a diffuser surface 30 located downstream of the Coanda surface 28 and a guide surface 32 located downstream of the diffuser surface 30. The diffuser surface 30 is arranged to taper away from the central axis X of the opening 24 in such a way so as to assist the flow of air emitted from the fan 10. The angle subtended between the diffuser surface 30 and the central axis X of the opening 24 is in the range from 5 to 15°, and in this example is around 7°. The guide surface 32 is arranged at an angle to the diffuser surface 30 to further assist the efficient delivery of a cooling air flow from the fan 10. The guide surface 32 is preferably arranged substantially parallel to the central axis X of the opening 24 to present a substantially flat and substantially smooth face to the air flow emitted from the mouth 26. A visually appealing tapered surface 34 is located downstream from the guide surface 32, terminating at a tip surface 36 lying substantially perpendicular to the central axis X of the opening 24. The angle subtended between the tapered surface 34 and the central axis X of the opening 24 is preferably around 45°. The overall depth of the nozzle 24 in a direction extending along the central axis X of the opening 24 is in the range from 100 to 150 mm, and in this example is around 110 mm.

Figure 3:
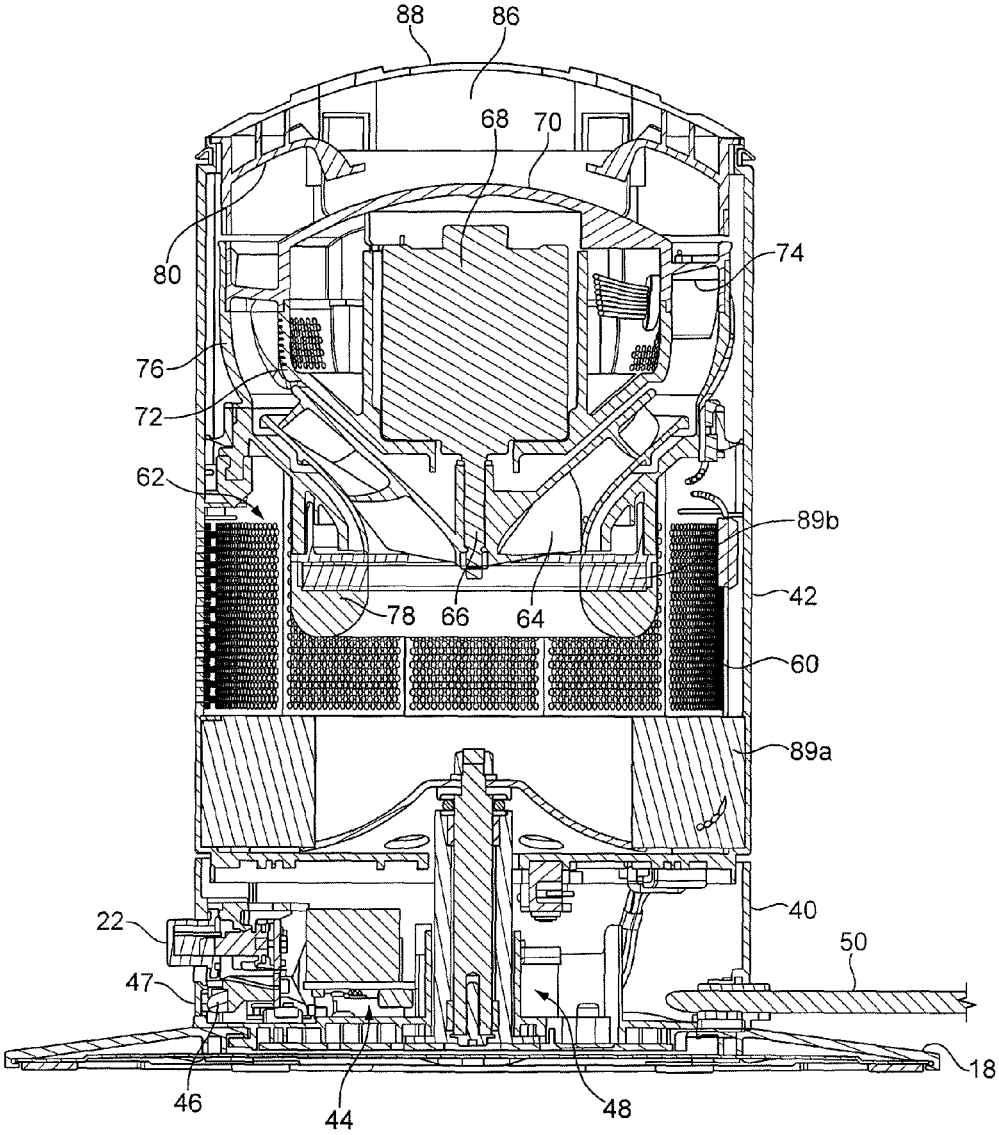
FIG. 3 is a cross-sectional view of the base of the fan of FIG. 1.
Figure 4:
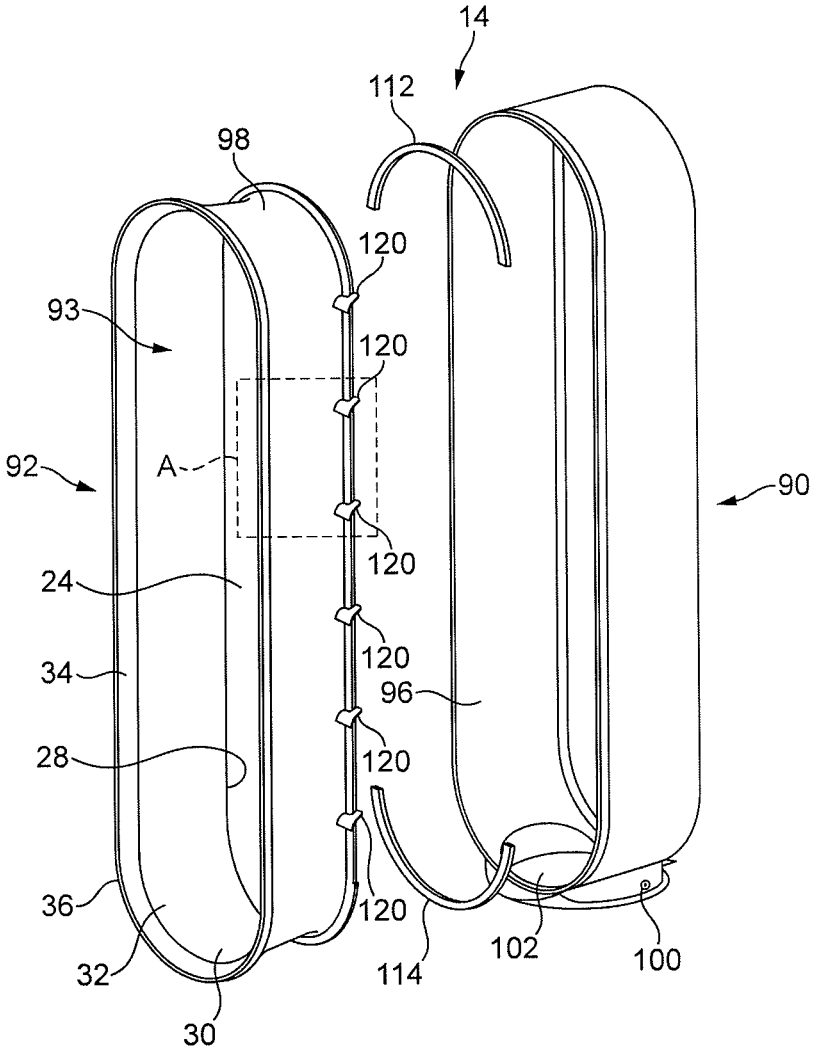
FIG. 4 is an exploded view of the nozzle of the fan of FIG. 1.
Figure 5:
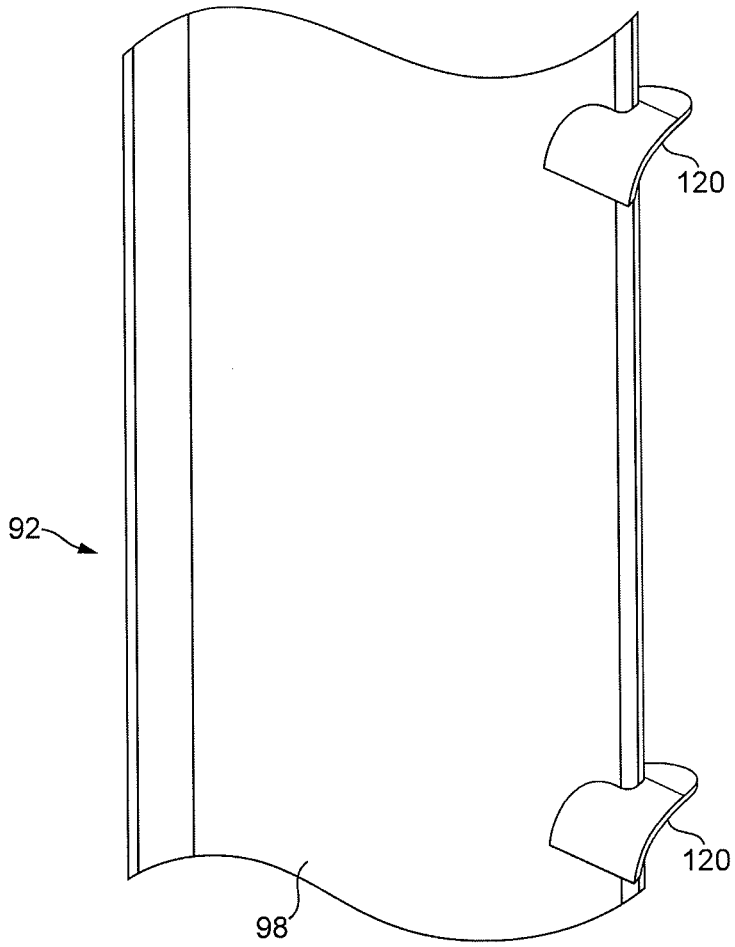
FIG. 5 is an enlarged view of area A indicated in FIG. 4.
Figure 6:
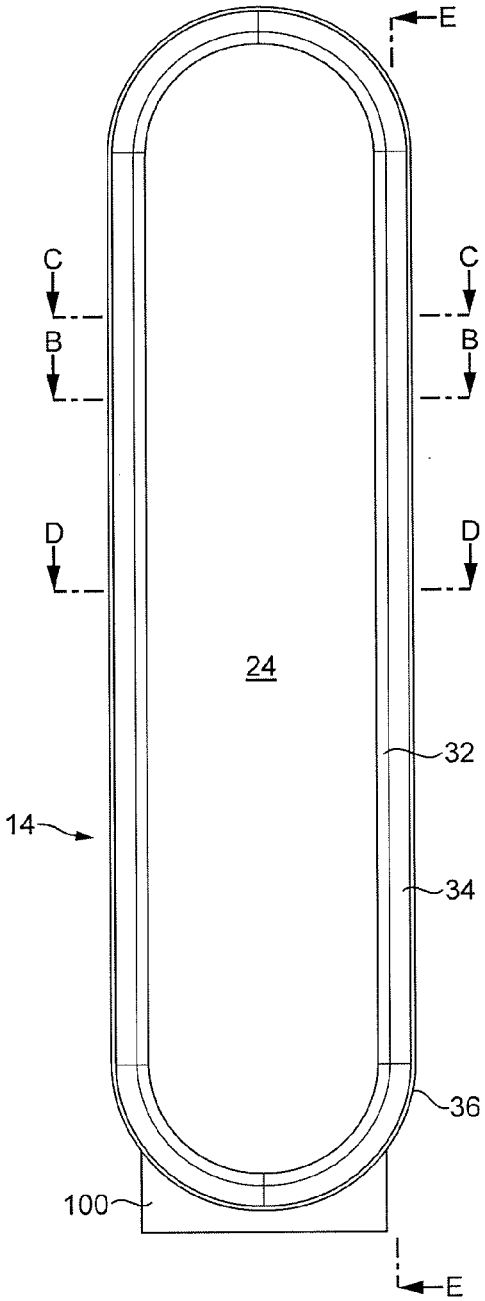
FIG. 6 is a front view of the nozzle of FIG. 4.

FIG. 3 illustrates a sectional view through the base 12 of the fan 10. The outer casing 16 of the base 12 comprises a lower casing section 40 and a main casing section 42 mounted on the lower casing section 40. The lower casing section 40 houses a controller, indicated generally at 44, for controlling the operation of the fan 10 in response to depression of the user operable buttons 21 shown in FIGS. 1 and 2, and/or manipulation of the user operable dial 22. The lower casing section 40 may optionally comprise a sensor 46 for receiving control signals from a remote control (not shown), and for conveying these control signals to the controller 44. These control signals are preferably infrared or RF signals. The sensor 46 is located behind a window 47 through which the control signals enter the lower casing section 40 of the outer casing 16 of the base 12. A light emitting diode (not shown) may be provided for indicating whether the fan 10 is in a stand-by mode. The lower casing section 40 also houses a mechanism, indicated generally at 48, for oscillating the main casing section 42 relative to the lower casing section 40. The range of each oscillation cycle of the main casing section 42 relative to the lower casing section 40 is preferably between 60° and 120°, and in this example is around 90°. In this example, the oscillating mechanism 48 is arranged to perform around 3 to 5 oscillation cycles per minute. A mains power cable 50 extends through an aperture formed in the lower casing section 40 for supplying electrical power to the fan 10.

The main casing section 42 comprises a cylindrical grille 60 in which an array of apertures 62 is formed to provide the air inlets 20 of the outer casing 16 of the base 12. The main casing section 42 houses an impeller 64 for drawing the primary air flow through the apertures 62 and into the base 12. Preferably, the impeller 64 is in the form of a mixed flow impeller. The impeller 64 is connected to a rotary shaft 66 extending outwardly from a motor 68. In this example, the motor 68 is a DC brushless motor having a speed which is variable by the controller 44 in response to user manipulation of the dial 22 and/or a signal received from the remote control. The maximum speed of the motor 68 is preferably in the range from 5,000 to 10,000 rpm. The motor 68 is housed within a motor bucket comprising an upper portion 70 connected to a lower portion 72. The upper portion 70 of the motor bucket comprises a diffuser 74 in the form of a stationary disc having spiral blades. The motor bucket is located within, and mounted on, a generally frusto-conical impeller housing 76 connected to the main casing section 42. The impeller 42 and the impeller housing 76 are shaped so that the impeller 64 is in close proximity to, but does not contact, the inner surface of the impeller housing 76. A substantially annular inlet member 78 is connected to the bottom of the impeller housing 76 for guiding the primary air flow into the impeller housing 76.

A profiled upper casing section 80 is connected to the open upper end of the main casing section 42 of the base 12, for example by means of snap-fit connections. An O-ring sealing member may be used to form an air-tight seal between the main casing section 42 and the upper casing section 80 of the base 12. The upper casing section 80 comprises a chamber 86 for receiving the primary air flow from the main casing section 42, and an aperture 88 through which the primary air flow passes from the base 12 into the nozzle 14.

Preferably, the base 12 further comprises silencing foam for reducing noise emissions from the base 12. In this embodiment, the main casing section 42 of the base 12 comprises a first, generally cylindrical foam member 89a located beneath the grille 60, and a second, substantially annular foam member 89b located between the impeller housing 76 and the inlet member 78.

The nozzle 14 will now be described with reference to FIGS. 4 to 13. The nozzle 14 comprises an elongate, annular outer casing section 90 connected to and extending about an elongate, annular inner casing section 92. The inner casing section 92 defines the central opening 24 of the nozzle 14, and has an external peripheral surface 93 which is shaped to define the Coanda surface 28, diffuser surface 30, guide surface 32 and tapered surface 34.

The outer casing section 90 and the inner casing section 92 together define an annular interior passage 94 of the nozzle 14. The interior passage 94 is located towards the front of the fan 10. The interior passage 94 extends about the opening 24, and thus comprises two substantially vertically extending sections each adjacent a respective elongate side of the central opening 24, an upper curved section joining the upper ends of the vertically extending sections, and a lower curved section joining the lower ends of the vertically extending sections. The interior passage 94 is bounded by the internal peripheral surface 96 of the outer casing section 90 and the internal peripheral surface 98 of the inner casing section 92. The outer casing section 90 comprises a base 100 which is connected to, and over, the upper casing section 80 of the base 12, for example by a snap-fit connection. The base 100 of the outer casing section 90 comprises an aperture 102 which is aligned with the aperture 88 of the upper casing section 80 of the base 12 and through which the primary air flow enters the lower curved portion of the interior passage 94 of the nozzle 14 from the base 12 of the fan 10.

Figure 8:
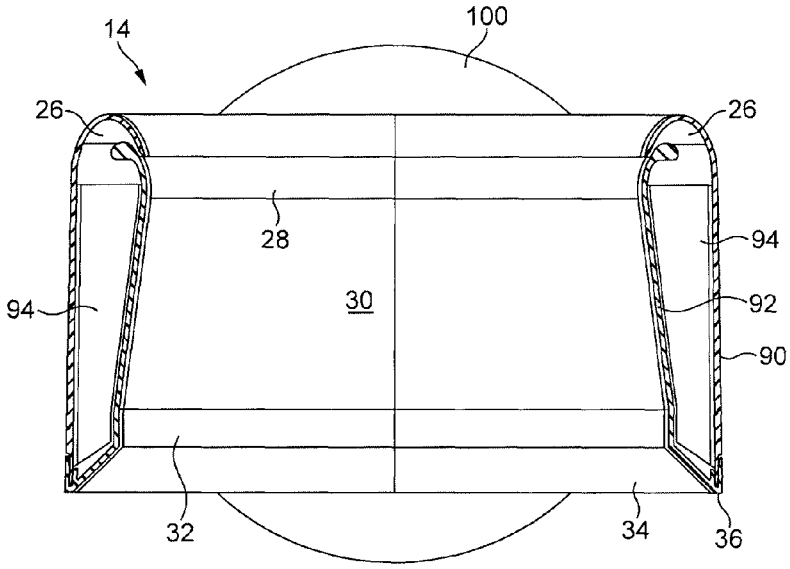
FIG. 8 is a sectional view of the nozzle taken along line D-D in FIG. 6.
Figure 9:
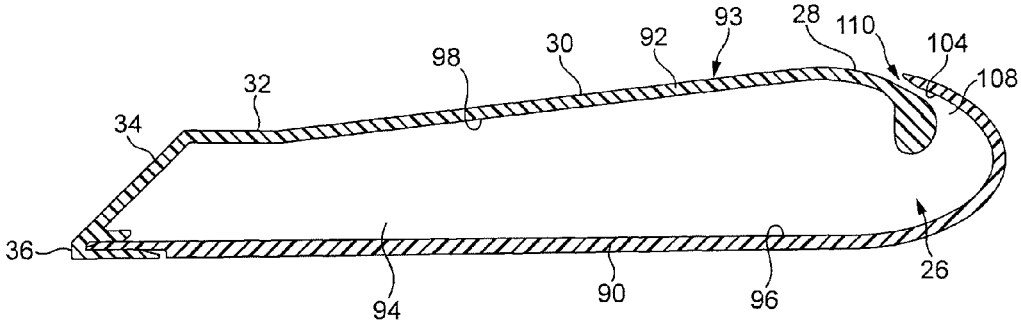
FIG. 9 is an enlarged view of a section of the nozzle illustrated in FIG. 8.
Figure 10:
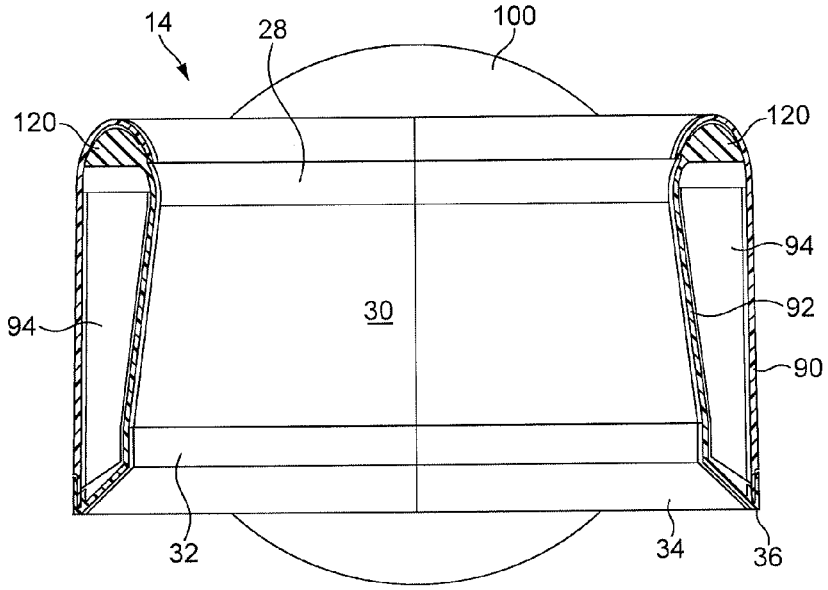
FIG. 10 is a sectional view of the nozzle taken along line C-C in FIG. 6.

With particular reference to FIGS. 8 and 9, the mouth 26 of the nozzle 14 is located towards the rear of the fan 10. The mouth 26 is defined by overlapping, or facing, portions 104, 106 of the internal peripheral surface 96 of the outer casing section 90 and the external peripheral surface 93 of the inner casing section 92, respectively. In this example, the mouth 26 comprises two sections each extending along a respective elongate side of the central opening 24 of the nozzle 14, and in fluid communication with a respective vertically extending section of the interior passage 94 of the nozzle 14. The air flow through each section of the mouth 26 is substantially orthogonal to the air flow through the respective vertically extending portion of the interior passage 94 of the nozzle 14. Each section of the mouth 26 is substantially U-shaped in cross-section, and so as a result the direction of the air flow is substantially reversed as the air flow passes through the mouth 26. In this example, the overlapping portions 104, 106 of the internal peripheral surface 96 of the outer casing section 90 and the external peripheral surface 93 of the inner casing section 92 are shaped so that each section of the mouth 26 comprises a tapering portion 108 narrowing to an outlet 110. Each outlet 110 is in the form of a substantially vertically extending slot, preferably having a relatively constant width in the range from 0.5 to 5 mm. In this example each outlet 110 has a width of around 1.1 mm.

The mouth 26 may thus be considered to comprise two outlets 110 each located on a respective side of the central opening 24. Returning to FIG. 4, the nozzle 14 further comprises two curved seal members 112, 114 each for forming a seal between the outer casing section 90 and the inner casing section 92 so that there is substantially no leakage of air from the curved sections of the interior passage 94 of the nozzle 14.

In order to direct the primary air flow into the mouth 26, the nozzle 14 comprises a plurality of stationary guide vanes 120 located within the interior passage 94 and each for directing a portion of the air flow towards the mouth 26. The guide vanes 120 are illustrated in FIGS. 4, 5, 7, 10 and 11. The guide vanes 120 are preferably integral with the internal peripheral surface 98 of the inner casing section 92 of the nozzle 14. The guide vanes 120 are curved so that there is no significant loss in the velocity of the air flow as it is directed into the mouth 26. In this example the nozzle 14 comprises two sets of guide vanes 120, with each set of guide vanes 120 directing air passing along a respective vertically extending portion of the interior passage 94 towards its associated section of the mouth 26. Within each set, the guide vanes 120 are substantially vertically aligned and evenly spaced apart to define a plurality of passageways 122 between the guide vanes 120 and through which air is directed into the mouth 26. The even spacing of the guide vanes 120 provides a substantially even distribution of the air stream along the length of the section of the mouth 26.

Figure 7:
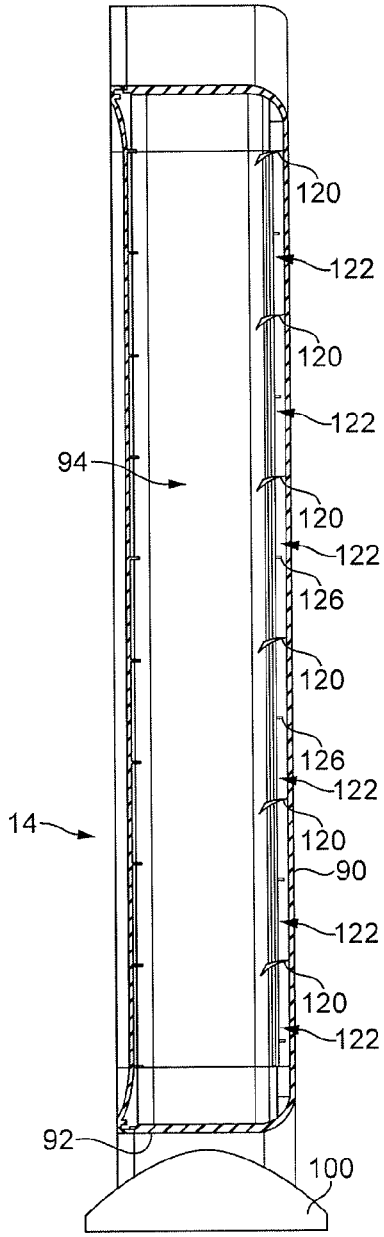
FIG. 7 is a sectional view of the nozzle taken along line E-E in FIG. 6.
Figure 11:
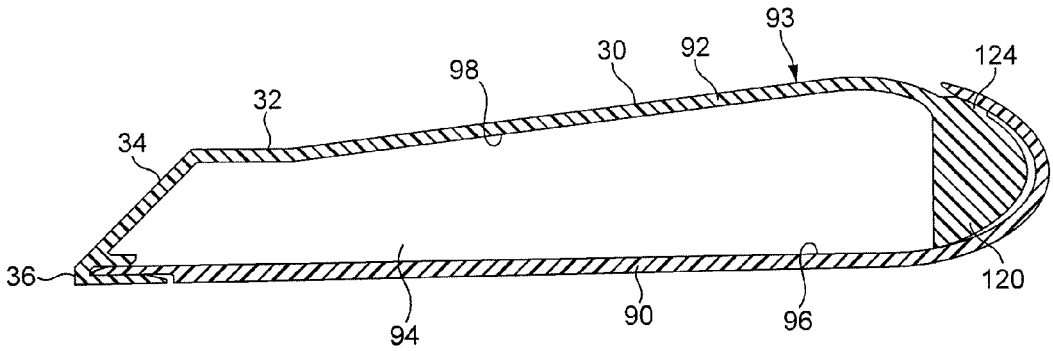
FIG. 11 is an enlarged view of a section of the nozzle illustrated in FIG. 10.
Figure 12:
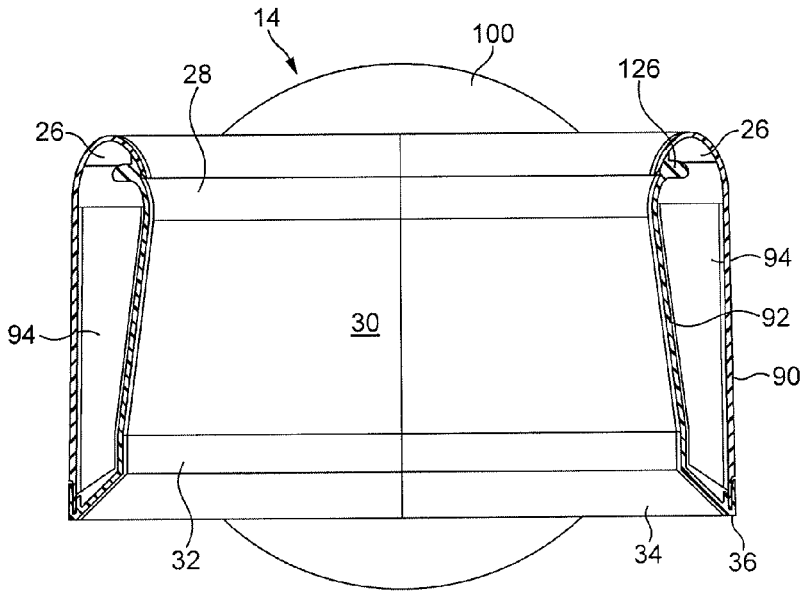
FIG. 12 is a sectional view of the nozzle taken along line B-B in FIG. 6.
Figure 13:
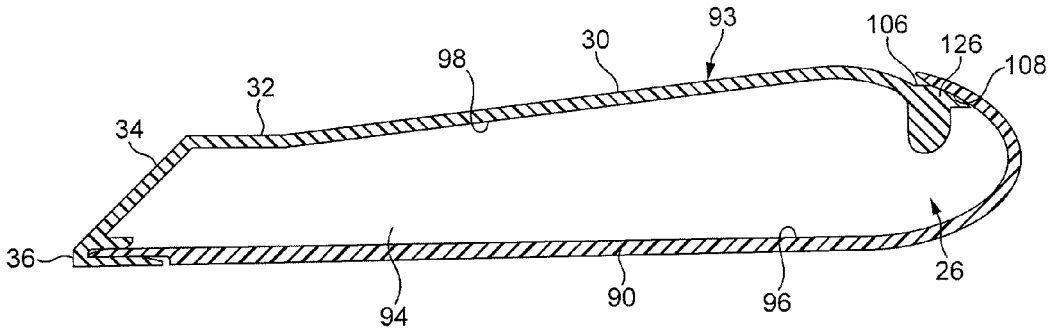
FIG. 13 is an enlarged view of a section of the nozzle illustrated in FIG. 12.

With reference to FIG. 11, the guide vanes 120 are preferably shaped so that a portion 124 of each guide vane 120 engages the internal peripheral surface 96 of the outer casing section 90 of the nozzle 24 so as to urge apart the overlapping portions 104, 106 of the internal peripheral surface 96 of the outer casing section 90 and the external peripheral surface 93 of the inner casing section 92. This can assist in maintaining the width of each outlet 110 at a substantially constant level along the length of each section of the mouth 26. With reference to FIGS. 7, 12 and 13, in this example additional spacers 126 are provided along the length of each section of the mouth 26, also for urging apart the overlapping portions 104, 106 of the internal peripheral surface 96 of the outer casing section 90 and the external peripheral surface 93 of the inner casing section 92, to maintain the width of the outlet 110 at the desired level. Each spacer 126 is located substantially midway between two adjacent guide vanes 120. To facilitate manufacture the spacers 126 are preferably integral with the external peripheral surface 98 of the inner casing section 92 of the nozzle 14. Additional spacers 126 may be provided between adjacent guide vanes 120 if so desired.

In use, when the user depresses an appropriate one of the buttons 21 on the base 12 of the fan 10 the controller 44 activates the motor 68 to rotate the impeller 64, which causes a primary air flow to be drawn into the base 12 of the fan 10 through the air inlets 20. The primary air flow may be up to 30 liters per second, more preferably up to 50 liters per second. The primary air flow passes through the impeller housing 76 and the upper casing section 80 of the base 12, and enters the base 100 of the outer casing section 90 of the nozzle 14, from which the primary air flow enters the interior passage 94 of the nozzle 14.

Figure 14:
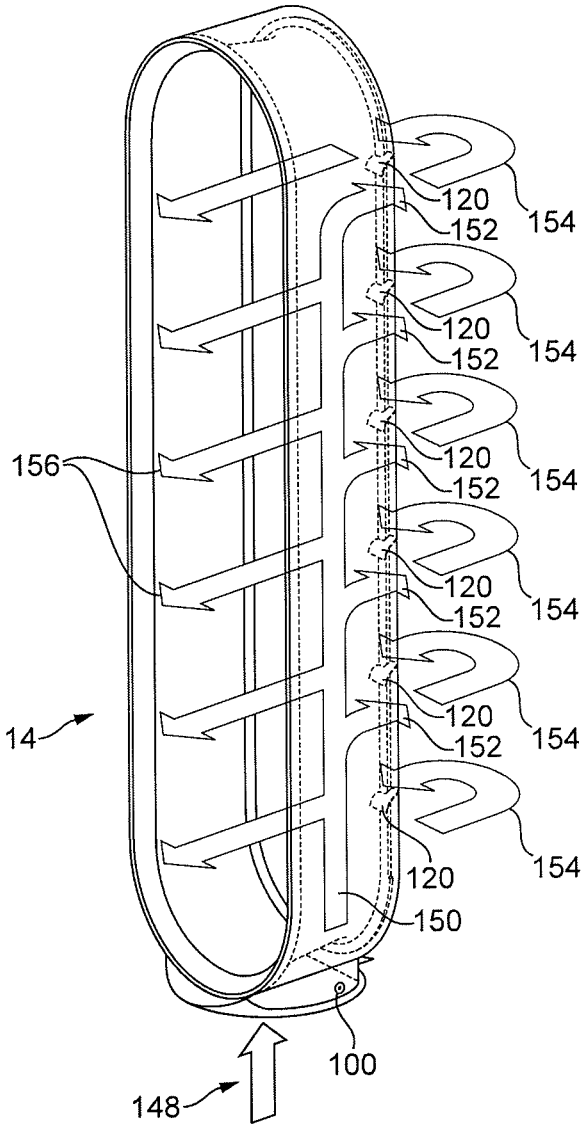
FIG. 14 illustrates the air flow through part of the nozzle of the fan of FIG. 1.
Figure 15:
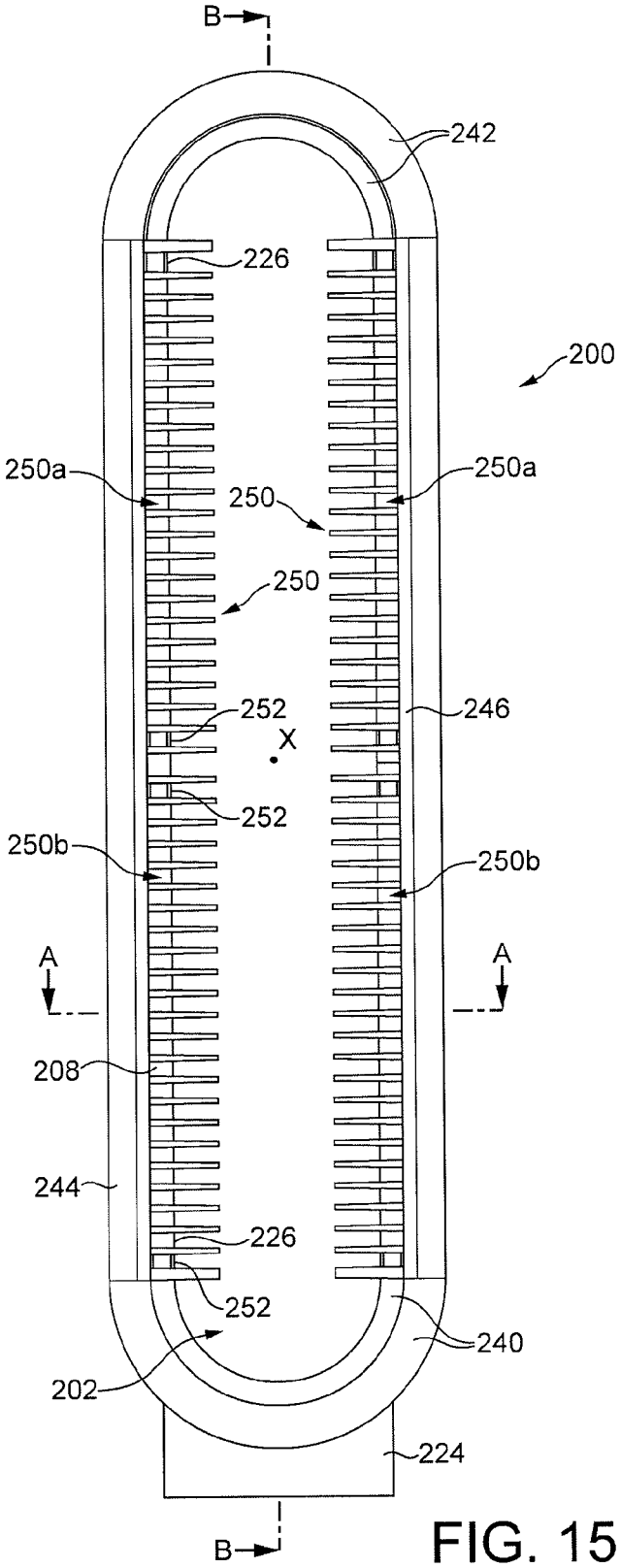
FIG. 15 is a front view of a first alternative nozzle for the fan of FIG. 1.
Figure 16:
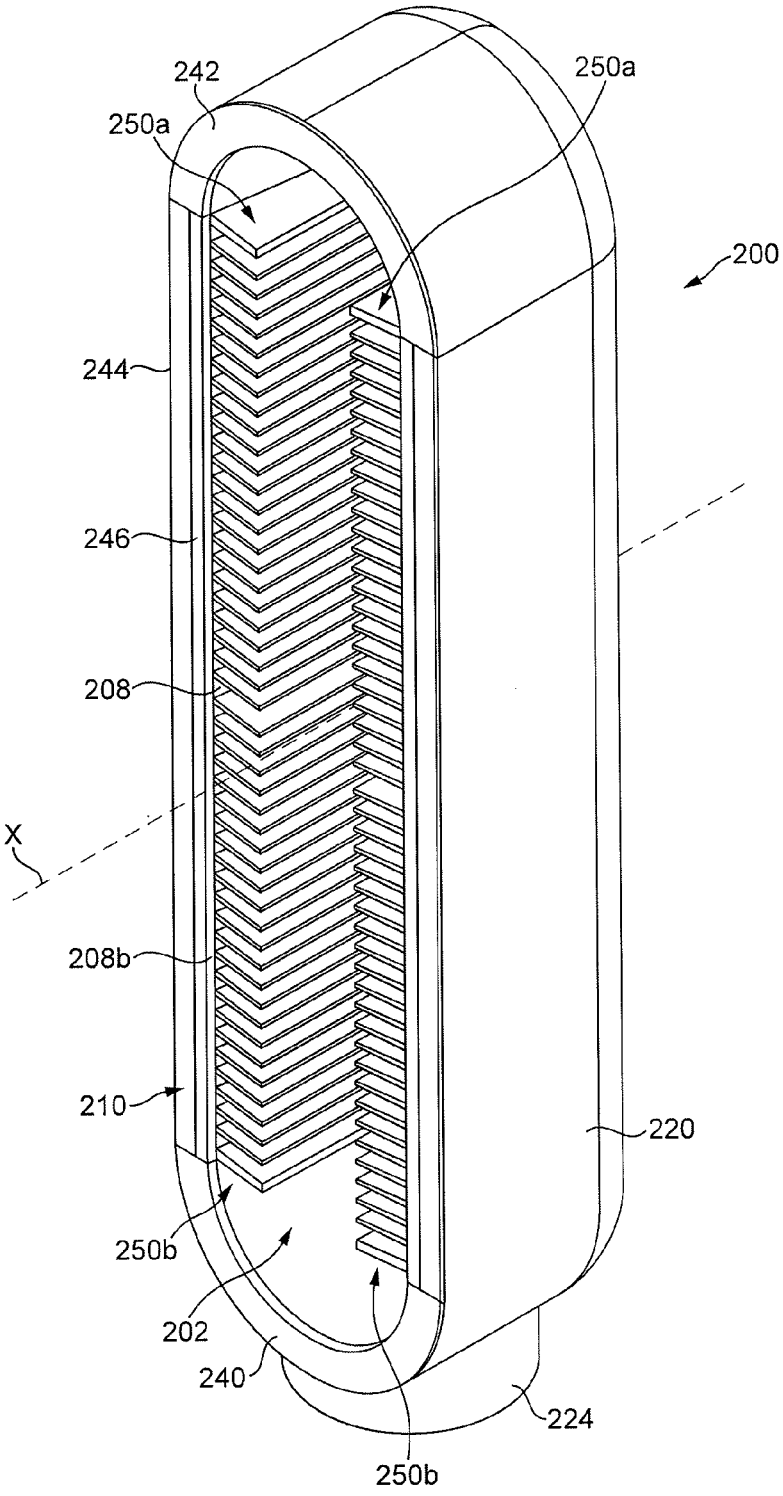
FIG. 16 is a perspective view of the nozzle of FIG. 15.

With reference also to FIG. 14 the primary air flow, indicated at 148, is divided into two air streams, one of which is indicated at 150 in FIG. 14, which pass in opposite directions around the central opening 24 of the nozzle 14. Each air stream 150 enters a respective one of the two vertically extending sections of the interior passage 94 of the nozzle 14, and is conveyed in a substantially vertical direction up through each of these sections of the interior passage 94. The set of guide vanes 120 located within each of these sections of the interior passage 94 directs the air stream 150 towards the section of the mouth 26 located adjacent that vertically extending section of the interior passage 94. Each of the guide vanes 120 directs a respective portion 152 of the air stream 150 towards the section of the mouth 26 so that there is a substantially uniform distribution of the air stream 150 along the length of the section of the mouth 26. The guide vanes 120 are shaped so that each portion 152 of the air stream 150 enters the mouth 26 in a substantially horizontal direction. Within each section of the mouth 26, the flow direction of the portion of the air stream is substantially reversed, as indicated at 154 in FIG. 14. The portion of the air stream is constricted as the section of the mouth 26 tapers towards the outlet 110 thereof, channeled around the spacer 126 and emitted through the outlet 110, again in a substantially horizontal direction.

The primary air flow emitted from the mouth 26 is directed over the Coanda surface 28 of the nozzle 14, causing a secondary air flow to be generated by the entrainment of air from the external environment, specifically from the region around the outlets 110 of the mouth 26 and from around the rear of the nozzle 14. This secondary air flow passes through the central opening 24 of the nozzle 14, where it combines with the primary air flow to produce a total air flow 156, or air current, projected forward from the nozzle 14.

The even distribution of the primary air flow along the mouth 26 of the nozzle 14 ensures that the air flow passes evenly over the diffuser surface 30. The diffuser surface 30 causes the mean speed of the air flow to be reduced by moving the air flow through a region of controlled expansion. The relatively shallow angle of the diffuser surface 30 to the central axis X of the opening 24 allows the expansion of the air flow to occur gradually. A harsh or rapid divergence would otherwise cause the air flow to become disrupted, generating vortices in the expansion region. Such vortices can lead to an increase in turbulence and associated noise in the air flow, which can be undesirable, particularly in a domestic product such as a fan. In the absence of the guide vanes 120 most of the primary air flow would tend to leave the fan 10 through the upper part of the mouth 26, and to leave the mouth 26 upwardly at an acute angle to the central axis of the opening 24. As a result there would be an uneven distribution of air within the air current generated by the fan 10. Furthermore, most of the air flow from the fan 10 would not be properly diffused by the diffuser surface 30, leading to the generation of an air current with much greater turbulence.

The air flow projected forwards beyond the diffuser surface 30 can tend to continue to diverge. The presence of the guide surface 32 extending substantially parallel to the central axis X of the opening 30 tends to focus the air flow towards the user or into a room.

An alternative nozzle 200 which may be mounted on and supported by the base 12 in place of the nozzle 14 will now be described with reference to FIGS. 15 to 18. The nozzle 200 is used to convert the fan 10 into a fan heater which may be used to create either a cooling air current similar to the fan 10 or a warming air current as required by the user. The nozzle 200 has substantially the same size and shape as the nozzle 14, and so defines a central elongate opening 202. As with the nozzle 14, the nozzle 200 comprises a mouth 204 located towards the rear of the nozzle 200 for emitting air through the opening 202. The mouth 204 extends at least partially about the opening 202. The inner periphery of the nozzle 200 comprises a Coanda surface 206 located adjacent the mouth 204 and over which the mouth 204 directs the air emitted from the nozzle 200, and a diffuser surface 208 located downstream of the Coanda surface 206. The diffuser surface 208 is arranged to taper away from the central axis X of the opening 202 in such a way so as to assist the flow of air emitted from the fan heater. The angle subtended between the diffuser surface 208 and the central axis X of the opening 24 is in the range from 5 to 25°, and in this example is around 7°. The diffuser surface 208 terminates at a front surface 210 lying substantially perpendicular to the central axis X of the opening 202.

Similar to the nozzle 14, the nozzle 200 comprises an elongate, annular outer casing section 220 connected to and extending about an elongate, annular inner casing section 222. The outer casing section 220 is substantially the same as the outer casing section 90 of the nozzle 14. The outer casing section 220 is preferably formed from plastics material. The outer casing section 220 comprises a base 224 which is connected to, and over, the upper casing section 80 of the base 12, for example by a snap-fit connection. The inner casing section 222 defines the central opening 202 of the nozzle 200, and has an external peripheral surface 226 which is shaped to define the Coanda surface 206, diffuser surface 208, and end surface 210.

The outer casing section 220 and the inner casing section 222 together define an annular interior passage 228 of the nozzle 200. The interior passage 228 extends about the opening 202, and thus comprises two substantially vertically extending sections each adjacent a respective elongate side of the central opening 202, an upper curved section joining the upper ends of the vertically extending sections, and a lower curved section joining the lower ends of the vertically extending sections. The interior passage 228 is bounded by the internal peripheral surface 230 of the outer casing section 220 and the internal peripheral surface 232 of the inner casing section 222. The base 224 of the outer casing section 220 comprises an aperture 234 which is aligned with the aperture 88 of the upper casing section 80 of the base 12 when the nozzle 200 is connected to the base 12. In use, the primary air flow passes through the aperture 234 from the base 12, and enters the lower curved portion of the interior passage 228 of the nozzle 220.

Figure 17:
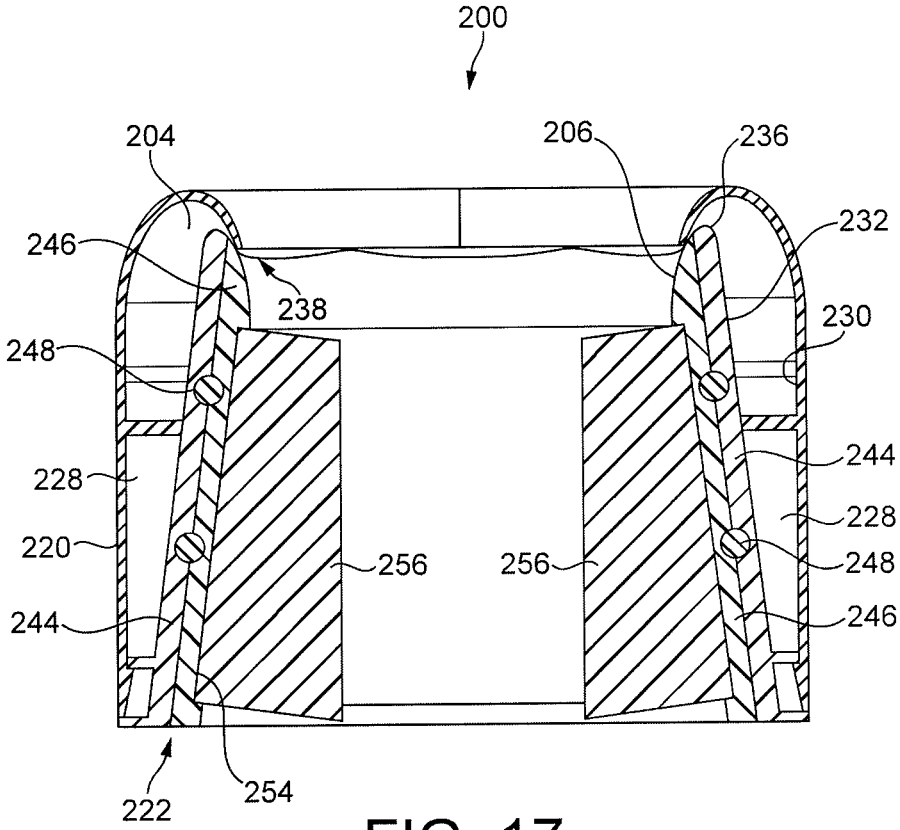
FIG. 17 is a sectional view of the nozzle of FIG. 15 taken along line A-A in FIG. 15.
Figure 18:
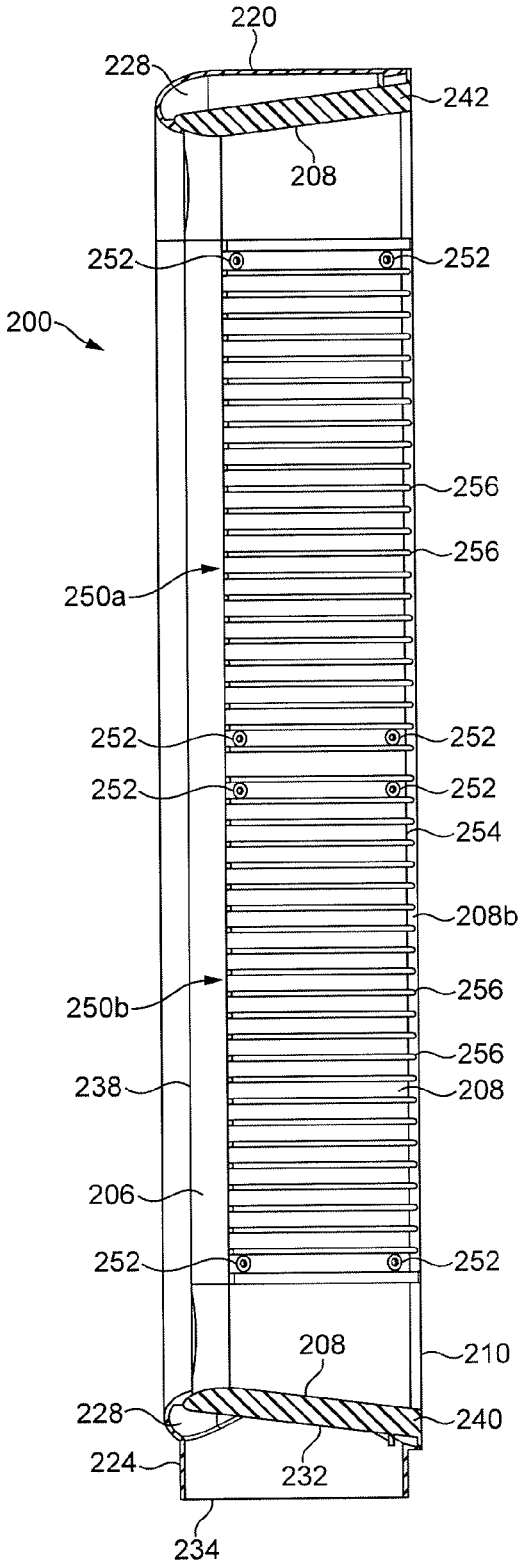
FIG. 18 is a sectional view of the nozzle of FIG. 15 taken along line B-B in FIG. 15.

With particular reference to FIGS. 17 and 18, the mouth 204 of the nozzle 200 is substantially the same as the mouth 26 of the nozzle 14. The mouth 204 is located towards the rear of the nozzle 200, and is defined by overlapping, or facing, portions of the internal peripheral surface 230 of the outer casing section 220 and the external peripheral surface 226 of the inner casing section 222, respectively. The mouth 204 comprises two sections each extending along a respective elongate side of the central opening 202 of the nozzle 200, and in fluid communication with a respective vertically extending section of the interior passage 228 of the nozzle 200. The air flow through each section of the mouth 204 is substantially orthogonal to the air flow through the respective vertically extending portion of the interior passage 228 of the nozzle 200. The mouth 204 is shaped so that the direction of the air flow is substantially reversed as the air flow passes through the mouth 204. The overlapping portions of the internal peripheral surface 230 of the outer casing section 220 and the external peripheral surface 226 of the inner casing section 222 are shaped so that each section of the mouth 204 comprises a tapering portion 236 narrowing to an outlet 238. Each outlet 238 is in the form of a substantially vertically extending slot, preferably having a relatively constant width in the range from 0.5 to 5 mm, more preferably in the range from 1 to 2 mm. In this example each outlet 238 has a width of around 1.7 mm. The mouth 204 may thus be considered to comprise two outlets 238 each located on a respective side of the central opening 202.

In this example, the inner casing section 222 of the nozzle 200 comprises a number of connected sections. The inner casing section 222 comprises a lower section 240 which defines, with the outer casing section 220, the lower curved section of the interior passage 228. The lower section 240 of the inner casing section 222 of the nozzle 200 is preferably formed from plastics material. The inner casing section 222 also comprises an upper section 242 which defines, with the outer casing section 220, the upper curved section of the interior passage 228. The upper section 242 of the inner casing section 222 is substantially identical to the lower section 240 of the inner casing section 222. As indicated in FIG. 18, each of the lower section 240 and the upper section 242 of the inner casing section 222 forms a seal with the outer casing section 220 so that there is substantially no leakage of air from the curved sections of the interior passage 228 of the nozzle 200.

The inner casing section 222 of the nozzle 200 further comprises two, substantially vertically extending sections each extending along a respective side of the central opening 202 and between the lower section 240 and the upper section 242 of the inner casing section 222. Each vertically extending section of the inner casing section 222 comprises an inner plate 244 and an outer plate 246 connected to the inner plate 244. Each of the inner plate 244 and the outer plate 246 is preferably formed from material having a higher thermal conductivity than the outer casing section 220 of the nozzle 200, and in this example each of the inner plate 244 and the outer plate 246 is formed from aluminium or an aluminium alloy. The inner plates 244 define, with the outer casing section 220, the vertically extending sections of the interior passage 228 of the nozzle 200. The outer plates 246 define the Coanda surface 206 over which air emitted from the mouth 204 is directed, and an end portion **208*b* of the diffuser surface 208**.

Each vertically extending section of the inner casing portion 222 comprises a set of cartridge heaters 248 located between the inner plate 244 and the outer plate 246 thereof In this embodiment, each set of cartridge heaters 248 comprises two, substantially vertically extending cartridge heaters 248, each having a length which is substantially the same as the lengths of the inner plate 244 and the outer plate 246. Each cartridge heater 248 may be connected to the controller 44 by power leads (not shown) extending through the base 234 of the outer casing portion 220 of the nozzle 200. The leads may terminate in connectors which mate with co-operating connectors located on the upper casing section 80 of the base 12 when the nozzle 200 is connected to the base 12. These co-operating connectors may be connected to power leads extending within the base 12 to the controller 44. At least one additional user operable button or dial may be provided on the lower casing section 40 of the base 12 to enable a user to activate selectively each set of cartridge heaters 248.

Each vertically extending section of the inner casing portion 222 further comprises a heat sink 250 connected to the outer plate 246 by pins 252. In this example, each heat sink 250 comprises an upper portion 250a and a lower portion 250b each connected to the outer plate 246 by four pins 252. Each portion of the heat sink 250 comprises a vertically extending heat sink plate 254 located within a recessed portion of the outer plate 246 so that the external surface of the heat sink plate 254 is substantially flush with the external surface of the outer plate 246. The external surface of the heat sink plate 254 forms part of the diffuser surface 208. The heat sink plate 254 is preferably formed from the same material as the outer plate 246. Each portion of the heat sink 250 comprises a stack of heat radiating fins 256 for dissipating heat to the air flow passing through the opening 202. Each heat radiating fin 256 extends outwardly from the heat sink plate 254 and partially across the opening 202. With reference to FIG. 17, in this example each heat radiating fin 256 is substantially trapezoidal. The heat radiating fins 256 are preferably formed from the same material as the heat sink plate 254, and are preferably integral therewith.

Each vertically extending section of the inner casing section 222 of the nozzle 200 may thus be considered as a respective heating unit for heating the air flow passing through the opening 202, with each of these heating units comprising an inner plate 244, an outer plate 246, a set of cartridge heaters 248 and a heat sink 250. Consequently, at least part of each heating unit is located downstream from the mouth 204, at least part of each heating unit defines part of the interior passage 228 with the outer casing portion 220 of the nozzle 200, and the interior passage 228 extends about these heating units.

The inner casing section 222 of the nozzle 200 may also comprise guide vanes located within the interior passage 228 and each for directing a portion of the air flow towards the mouth 204. The guide vanes are preferably integral with the internal peripheral surfaces of the inner plates 244 of the inner casing section 222 of the nozzle 200. Otherwise, these guide vanes are preferably substantially the same as the guide vanes 120 of the nozzle 14 and so will not be described in detail here. Similar to the nozzle 14, spacers may be provided along the length of each section of the mouth 204 for urging apart the overlapping portions of the internal peripheral surface 230 of the outer casing section 220 and the external peripheral surface 226 of the inner casing section 222 to maintain the width of the outlets 238 at the desired level.

In use, an air current of relatively low turbulence is created and emitted from the fan heater in the same way that such an air current is created and emitted from the fan 10, as described above with reference to FIGS. 1 to 14. When none of the heating units have been activated by the user, the cooling effect of the fan heater is similar to that of the fan 10. When the user has depressed the additional button on the base 12, or manipulated the additional dial, to activate one or more of the heater units, the controller 44 activates the set of cartridge heaters 248 of those heater units. The heat generated by the cartridge heaters 248 is transferred by conduction to the inner plate 244, the outer plate 246, and the heat sink 250 associated with each activated set of cartridge heaters 248. The heat is dissipated from the external surfaces of the heat radiating fins 256 to the air flow passing through the opening 202, and, to a much lesser extent, from the internal surface of the inner plate 244 to part of the primary air flow passing through the interior passage 228. Consequently, a current of warm air is emitted from the fan heater. This current of warm air can travel efficiently out from the nozzle 200, losing less energy and velocity to turbulence than the air flow generated by prior art fan heaters.

Due to the relatively high flow rate of the air current generated by the fan heater, the temperature of the external surfaces of the heating units can be maintained at a relatively low temperature, for example in the range of 50 to 70° C., while enabling a user located several meters from the fan heater to experience rapidly the heating effect of the fan heater. This can inhibit serious user injury through accidental contact with the external surfaces of the heating units during use of the fan heater. Another advantage associated with this relatively low temperature of the external surfaces of the heating units is that this temperature is insufficient to generate an unpleasant "burnt dust" smell when the heating unit is activated.

Figure 19:
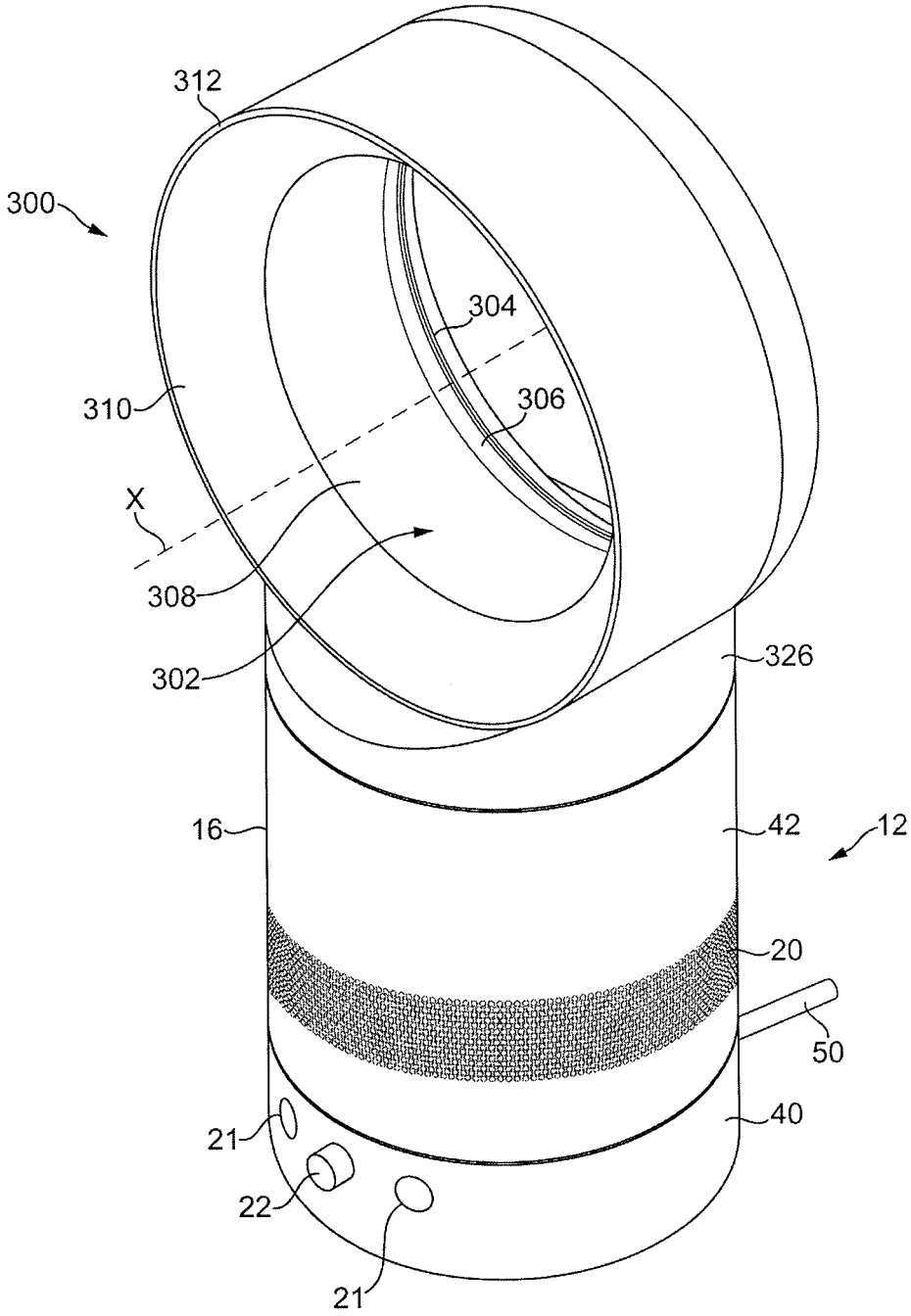
FIG. 19 is a perspective view of another domestic fan.
Figure 20:
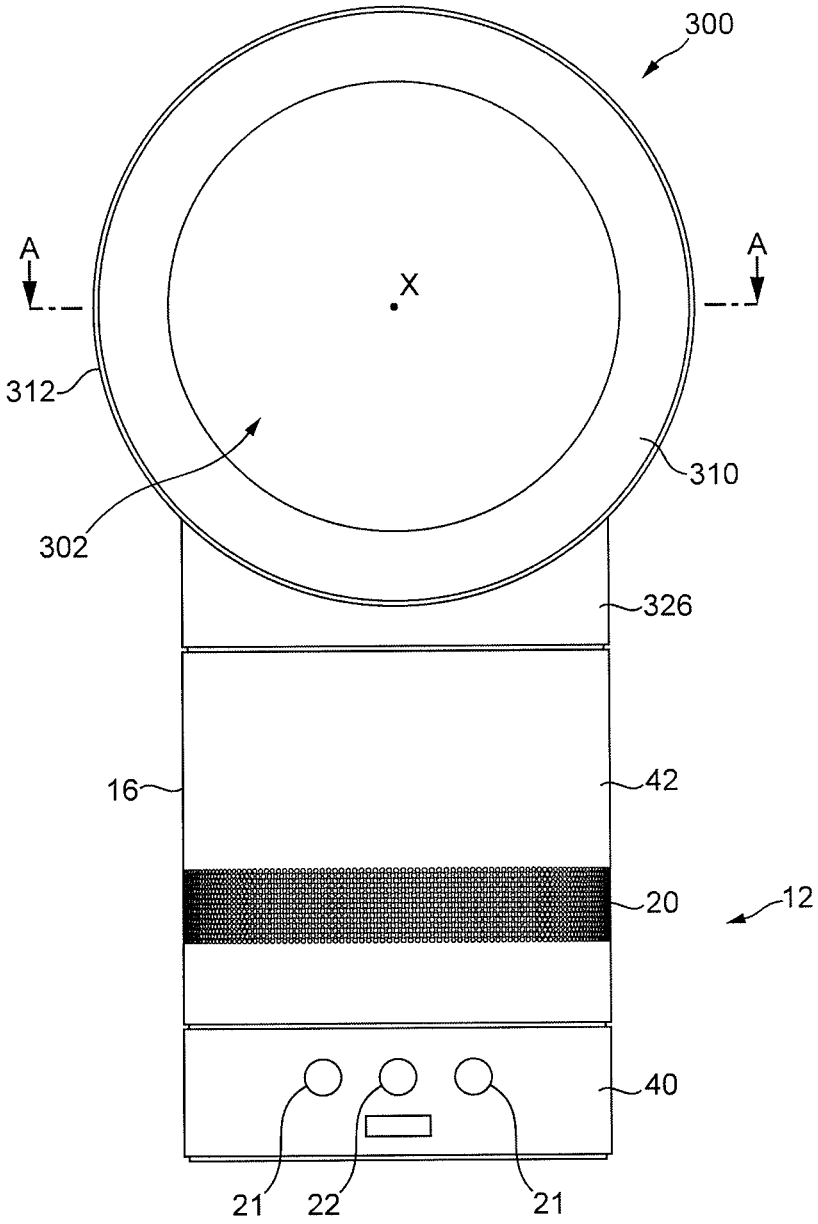
FIG. 20 is a front view of the fan of FIG. 19.
Figure 21:
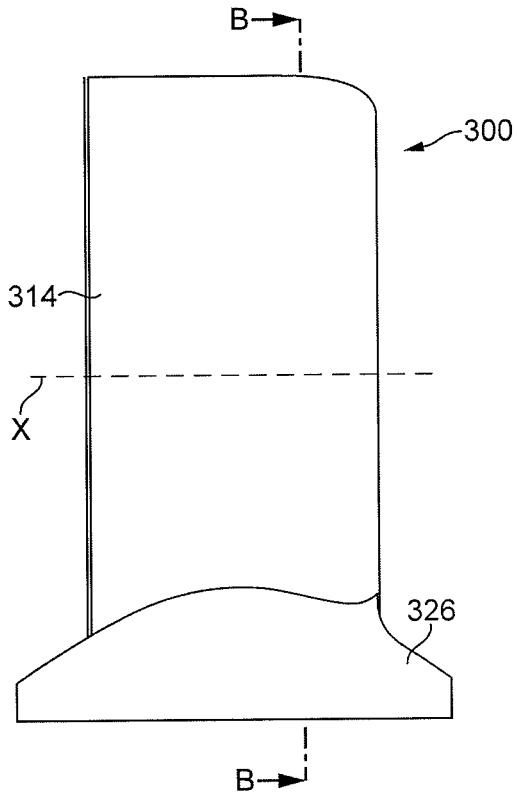
FIG. 21 is a side view of the nozzle of the fan of FIG. 19.

FIGS. 19 to 21 illustrate another alternative nozzle 300 mounted on and supported by the base 12 in place of the nozzle 14. Similar to the nozzle 200, the nozzle 300 is used to convert the fan 10 into a fan heater which may be used to create either a cooling air current similar to the fan 10 or a warming air current as required by the user. The nozzle 300 has a different size and shape to the nozzle 14 and the nozzle 200. In this example, the nozzle 300 defines a circular, rather than an elongate, central opening 302.

The nozzle 300 preferably has a height in the range from 150 to 400 mm, and in this example has a height of around 200 mm.

As with the previous nozzles 14, 200, the nozzle 300 comprises a mouth 304 located towards the rear of the nozzle 300 for emitting the primary air flow through the opening 302. In this example, the mouth 304 extends substantially completely about the opening 302. The inner periphery of the nozzle 300 comprises a Coanda surface 306 located adjacent the mouth 304 and over which the mouth 304 directs the air emitted from the nozzle 300, and a diffuser surface 308 located downstream of the Coanda surface 306. In this example, the diffuser surface 308 is a substantially cylindrical surface coaxial with the central axis X of the opening 302. A visually appealing tapered surface 310 is located downstream from the diffuser surface 308, terminating at a tip surface 312 lying substantially perpendicular to the central axis X of the opening 302. The angle subtended between the tapered surface 310 and the central axis X of the opening 302 is preferably around 45°. The overall depth of the nozzle 300 in a direction extending along the central axis X of the opening 302 is preferably in the range from 90 to 150 mm, and in this example is around 100 mm.

Figure 22:
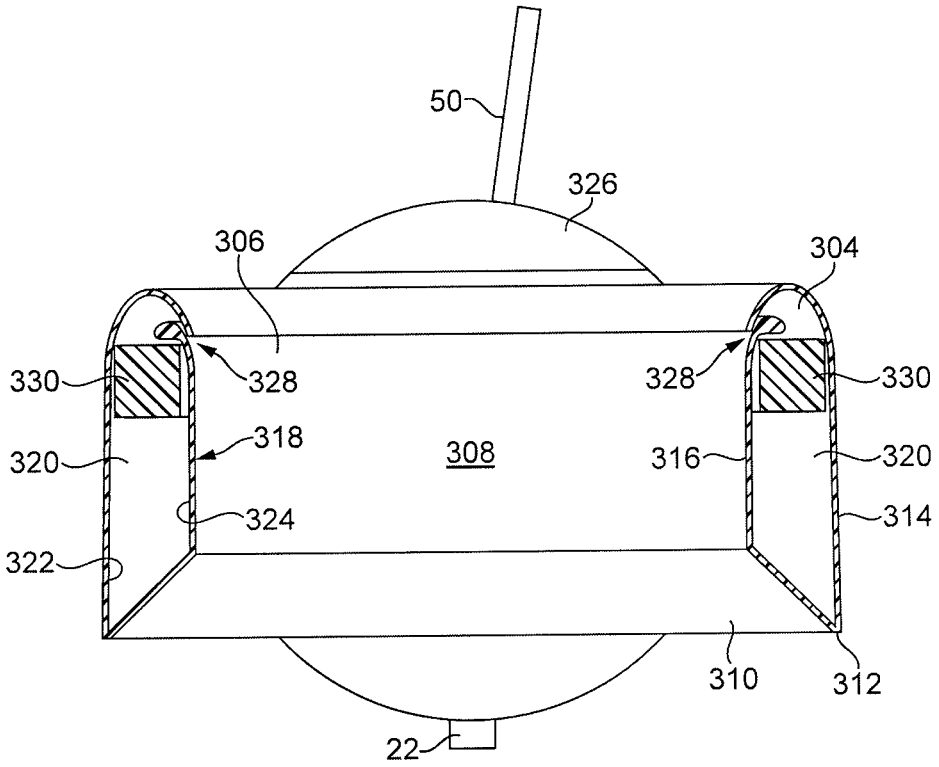
FIG. 22 is a sectional view taken along line A-A in FIG. 20.

FIG. 22 illustrates a top sectional view through the nozzle 300. Similar to the nozzles 14, 200, the nozzle 300 comprises an annular outer casing section 314 connected to and extending about an annular inner casing section 316. The casing sections 314, 316 are preferably connected together at or around the tip 312 of the nozzle 300. Each of these sections may be formed from a plurality of connected parts, but in this example each of the outer casing section 314 and the inner casing section 316 is formed from a respective, single moulded part. The inner casing section 316 defines the central opening 302 of the nozzle 300, and has an external peripheral surface 318 which is shaped to define the Coanda surface 306, diffuser surface 308, and tapered surface 310. Each of the casing sections 314, 316 is preferably formed from plastics material.

The outer casing section 314 and the inner casing section 316 together define an annular interior passage 320 of the nozzle 300. Thus, the interior passage 320 extends about the opening 24. The interior passage 320 is bounded by the internal peripheral surface 322 of the outer casing section 314 and the internal peripheral surface 324 of the inner casing section 316. The outer casing section 314 comprises a base 326 which is connected to, and over, the open upper end of the main body 42 of the base 12, for example by a snap-fit connection. Similar to the base 100 of the outer casing section 90 of the nozzle 14, the base 326 of the outer casing section 314 comprises an aperture through which the primary air flow enters the interior passage 320 of the nozzle 14 from the open upper end of the main body 42 of the base 12.

The mouth 304 is located towards the rear of the nozzle 300. Similar to the mouth 26 of the nozzle 14, the mouth 304 is defined by overlapping, or facing, portions of the internal peripheral surface 322 of the outer casing section 314 and the external peripheral surface 318 of the inner casing section 316. In this example, the mouth 304 is substantially annular and, as illustrated in FIG. 21, has a substantially U-shaped cross-section when sectioned along a line passing diametrically through the nozzle 14. In this example, the overlapping portions of the internal peripheral surface 322 of the outer casing section 314 and the external peripheral surface 318 of the inner casing section 316 are shaped so that the mouth 302 tapers towards an outlet 328 arranged to direct the primary air flow over the Coanda surface 306. The outlet 328 is in the form of an annular slot, preferably having a relatively constant width in the range from 0.5 to 5 mm. In this example the outlet 328 has a width of around 1 to 2 mm. Spacers may be spaced about the mouth 302 for urging apart the overlapping portions of the internal peripheral surface 322 of the outer casing section 314 and the external peripheral surface 318 of the inner casing section 316 to maintain the width of the outlet 328 at the desired level. These spacers may be integral with either the internal peripheral surface 322 of the outer casing section 314 or the external peripheral surface 318 of the inner casing section 316.

Figure 23:
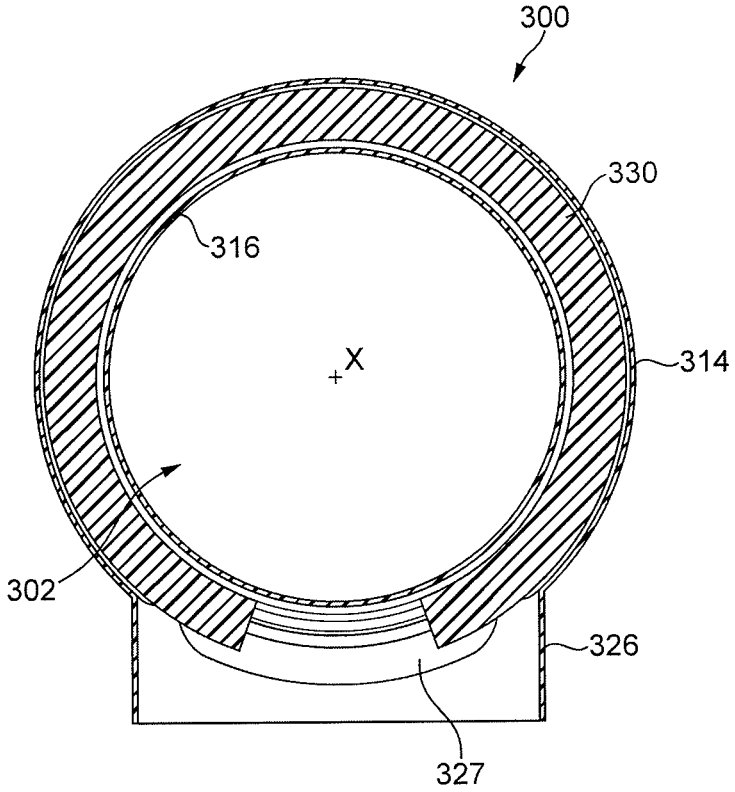
FIG. 23 is a sectional view taken along line B-B in FIG. 21.

The nozzle 300 comprises at least one heater for heating the primary air flow before it is emitted from the mouth 304. In this example, the nozzle 300 comprises a plurality of heaters, indicated generally at 330, located within the interior passage 320 of the nozzle 300 and through which the primary air flow passes as it flows through the nozzle 300. As illustrated in FIG. 23, the heaters 330 are preferably arranged in an array which extends about the opening 302, and is preferably located in a plane extending orthogonal to the axis X of the nozzle 300. The array preferably extends at least 270° about the axis X, more preferably at least 315° about the axis X. In this example, the array of heaters 330 extends around 320° about the axis, with each end of the array terminating at or around a respective side of the aperture in the base 326 of the outer casing section 314. The array of heaters 330 is preferably arranged towards the rear of the interior passage 320 so that substantially all of the primary air flow passes through the array of heaters 330 before entering the mouth 304, and less heat is lost to the plastic parts of the nozzle 300.

The array of heaters 330 may be provided by a plurality of ceramic heaters arranged side-by-side within the interior passage 320. The heaters 330 are preferably formed from porous, positive temperature coefficient (PTC) ceramic material, and may be located within respective apertures formed in an arcuate metallic frame which is located within, for example, the outer casing section 314 before the inner casing section 316 is attached thereto. Power leads extending from the frame may extend through the base 326 of the outer casing section 314 and terminate in connectors which mate with co-operating connectors located on the upper casing section 80 of the base 12 when the nozzle 300 is connected to the base 12. These co-operating connectors may be connected to power leads extending within the base 12 to the controller 44. At least one additional user operable button or dial may be provided on the lower casing section 40 of the base 12 to enable a user to activate the array of heaters 330. During use the maximum temperature of the heaters 330 is around 200° C.

In use, the operation of the fan assembly 10 with the nozzle 300 is much the same as the operation of the fan assembly with the nozzle 200. When the user has depressed the additional button on the base 12, or manipulated the additional dial, the controller 44 activates the array of heaters 330. The heat generated by the array of heaters 330 is transferred by convection to the primary air flow passing through the interior passage 320 so that a heated primary air flow is emitted from the mouth 304 of the nozzle 300. The heated primary air flow entrains air from the room space, region or external environment surrounding the mouth 304 of the nozzle 300 as it passes over the Coanda surface 306 and through the opening 302 defined by the nozzle 300, resulting in an overall air flow projected forward from the fan assembly 10 which has a lower temperature than the primary air flow emitted from the mouth 304, but a higher temperature than the air entrained from the external environment. Consequently, a current of warm air is emitted from the fan assembly. As with the current of warm air generated by the nozzle 200, this current of warm air can travel efficiently out from the nozzle 300, losing less energy and velocity to turbulence than the air flow generated by prior art fan heaters.

The invention is not limited to the detailed description given above. Variations will be apparent to the person skilled in the art.

The invention claimed is:

1. A bladeless fan assembly for creating an air current, the fan assembly comprising:

a device for creating an air flow;

a nozzle comprising an inner casing section, an outer casing section extending about the inner casing section, an interior passage located between the outer casing section and the inner casing section for receiving the air flow, and a mouth for emitting the air flow, the inner casing section extending about an opening through which air from outside the fan assembly is drawn by the air flow emitted from the mouth, the inner casing section comprising a curved lower section, a curved upper section, and two side sections extending between the lower section and the upper section, each side section being located on a respective side of the opening; and a plurality of heaters, each of the plurality of heaters being located at least partially within the nozzle and adjacent a respective side section of the inner casing section.

2. The fan assembly of claim 1, wherein the interior passage is annular.

3. The fan assembly of claim 1, wherein each of the plurality of heaters comprises a ceramic heater.

4. The fan assembly of claim 1, wherein each of the plurality of heaters comprises a plurality of heat radiating fins.

5. The fan assembly of claim 1, wherein each of the plurality of heaters is in thermal contact with the interior passage.

6. The fan assembly of claim 1, wherein each of the plurality of heaters is configured to heat the air drawn through the opening by the air flow emitted from the mouth.

7. The fan assembly of claim 1, wherein the mouth comprises an outlet located between the external surface of the inner casing section of the nozzle and an internal surface of the outer casing section of the nozzle.

8. The fan assembly of claim 7, wherein the outlet is in the form of a slot.

9. The fan assembly of claim 1, wherein the outlet has a width in the range from 0.5 to 5 mm.

10. The fan assembly of claim 1, wherein each of the plurality of heaters is arranged to heat the inner casing section of the nozzle.

11. The fan assembly of claim 1, wherein each of the plurality of heaters is located at least partially within the interior passage of the nozzle.

12. The fan assembly of claim 1, wherein each of the plurality of heaters is connected to the internal surface of the inner casing section of the nozzle.

13. The fan assembly of claim 1, wherein the mouth comprises a plurality of outlets spaced about the opening.

14. A nozzle for a fan assembly for creating an air current, the nozzle comprising an inner casing section, an outer casing section extending about the inner casing section, an interior passage located between the outer casing section and the inner casing section for receiving an air flow, and a mouth for emitting the air flow, the inner casing section extending about an opening through which air from outside the fan assembly is drawn by the air flow emitted from the mouth, the inner casing section comprising a curved lower section, a curved upper section, and two side sections extending between the lower section and the upper section, each side section being located on a respective side of the opening; and a plurality of heaters, each of the plurality of heaters being located at least partially within the nozzle and adjacent a respective side section of the inner casing section.

15. The nozzle of claim 14, wherein the interior passage is annular.

16. The nozzle of claim 14, wherein each of the plurality of heaters comprises a ceramic heater.

17. The nozzle of claim 14, wherein each of the plurality of heaters comprises a plurality of heat radiating fins.

18. The nozzle of claim 14, wherein each of the plurality of heaters is in thermal contact with the interior passage.

19. The nozzle of claim 14, wherein each of the plurality of heaters is configured to heat the air drawn through the opening by the air flow emitted from the mouth.

20. The nozzle of claim 14, wherein the mouth comprises an outlet located between the external surface of the inner casing section of the nozzle and an internal surface of the outer casing section of the nozzle.

21. The nozzle of claim 20, wherein the outlet is in the form of a slot.

22. The nozzle of claim 14, wherein the outlet has a width in the range from 0.5 to 5 mm.

23. The nozzle of claim 14, wherein each of the plurality of heaters is arranged to heat the inner casing section of the nozzle.

24. The nozzle of claim 14, wherein each of the plurality of heaters is located at least partially within the interior passage of the nozzle.

25. The nozzle of claim 14, wherein each of the plurality of heaters is connected to the internal surface of the inner casing section of the nozzle.

26. The nozzle of claim 14, wherein the mouth comprises a plurality of outlets spaced about the opening.

* * * * *